US011289809B2

(12) United States Patent
Adela et al.

(10) Patent No.: US 11,289,809 B2
(45) Date of Patent: Mar. 29, 2022

(54) DUAL-BAND DIRECTIONAL ANTENNA, WIRELESS DEVICE, AND WIRELESS COMMUNICATION SYSTEM

(71) Applicant: THE ANTENNA COMPANY INTERNATIONAL N.V., Willemstad (CW)

(72) Inventors: Bedilu Befekadu Adela, Eindhoven (NL); Daniel Alexandru Cringus, Veldhoven (NL); Diego Caratelli, Eersel (NL)

(73) Assignee: THE ANTENNA COMPANY INTERNATIONAL N.V., Willemstad (CW)

( * ) Notice: Subject to any disclaimer, the term of this patent is extended or adjusted under 35 U.S.C. 154(b) by 49 days.

(21) Appl. No.: 16/831,002

(22) Filed: Mar. 26, 2020

(65) Prior Publication Data

US 2020/0313295 A1 Oct. 1, 2020

(30) Foreign Application Priority Data

Mar. 27, 2019 (NL) ..... 2022823

(51) Int. Cl.
*H01Q 5/30* (2015.01)
*H01Q 21/24* (2006.01)
*H01Q 1/24* (2006.01)

(52) U.S. Cl.
CPC ..... *H01Q 5/30* (2015.01); *H01Q 1/246* (2013.01); *H01Q 21/24* (2013.01)

(58) Field of Classification Search
CPC ..... H01Q 5/30; H01Q 1/246; H01Q 21/0043; H01Q 21/064; H01Q 21/24; H01Q 13/08; H01Q 13/085; H01Q 13/10; H01Q 19/13
See application file for complete search history.

(56) References Cited

U.S. PATENT DOCUMENTS 6,069,589 A * 5/2000 Lewis, Jr ..... H01Q 1/288 343/700 MS
6,806,831 B2 * 10/2004 Johansson ..... H01Q 9/0414 343/700 MS
7,227,506 B1 * 6/2007 Lewis, Jr. ..... H01Q 1/288 343/700 MS (Continued)

OTHER PUBLICATIONS

International Search Report and Written Opinion dated Jun. 1, 2019 issued in corresponding Netherlands Application No. NL2022823.

*Primary Examiner* — Jason Crawford
(74) *Attorney, Agent, or Firm* — Nath, Goldberg & Meyer; Joshua B. Goldberg

(57) ABSTRACT

A dual-band directional antenna for customer-premise equipment (CPE) applications is provided. The dual-band directional antenna includes at least one conductive radiating element, a probing structure connected to the radiating element, a conductive ground plane, and at least one mounting element for mounting the at least one radiating element on the ground plane at a distance therefrom. The antenna is configured to operate in two different frequency bands. The radiating element partially encloses at least one first cut-out portion and partially encloses at least one second cut-out portion, where the at least one first cut-out portion and the at least one second cut-out portion are positioned at opposite sides of a first slot of the radiating element.

19 Claims, 15 Drawing Sheets

(56) References Cited

U.S. PATENT DOCUMENTS

| | | | | |
|---|---|---|---|---|
| 7,439,926 | B2 * | 10/2008 | Mikami | H01Q 9/16 343/789 |
| 7,864,117 | B2 * | 1/2011 | Aurinsalo | H01Q 21/065 343/700 MS |
| 10,886,608 | B2 * | 1/2021 | Kim | H01Q 13/10 |
| 2002/0050954 | A1 * | 5/2002 | Jeong-Kun | H01Q 7/00 343/770 |
| 2005/0110685 | A1 * | 5/2005 | Frederik du Toit | H01Q 19/005 343/700 MS |
| 2007/0194999 | A1 * | 8/2007 | Morton | H01Q 5/357 343/767 |
| 2007/0241983 | A1 * | 10/2007 | Cao | H01Q 21/26 343/797 |
| 2008/0174506 | A1 * | 7/2008 | Jeng | H01Q 13/16 343/822 |
| 2012/0068892 | A1 * | 3/2012 | Shtrom | H01Q 21/205 343/702 |
| 2013/0063310 | A1 * | 3/2013 | Mak | H01Q 21/08 343/700 MS |
| 2013/0194146 | A1 * | 8/2013 | Lee | H01Q 5/50 343/767 |
| 2014/0071009 | A1 * | 3/2014 | Cheng | H01Q 5/371 343/770 |
| 2014/0152518 | A1 * | 6/2014 | Choudhury | H01Q 5/357 343/729 |
| 2015/0042535 | A1 * | 2/2015 | Orban | H01Q 21/20 343/841 |
| 2016/0294065 | A1 * | 10/2016 | Lindmark | H01Q 21/08 |
| 2020/0313295 | A1 * | 10/2020 | Adela | H01Q 7/00 |

* cited by examiner

DUAL-BAND DIRECTIONAL ANTENNA, WIRELESS DEVICE, AND WIRELESS COMMUNICATION SYSTEM

BACKGROUND

1. Field

The invention relates to a dual-band directional antenna, in particular for customer-premise equipment (CPE) applications. The invention further relates to a radiating element for use in an antenna according to the invention. The invention also relates to a wireless device for customer-premise equipment (CPE) applications, such as a wireless access points (AP), a router, a gateway, and/or a bridge, comprising at least one antenna according to the invention. The invention additionally relates to a wireless communication system, comprising a plurality of antennas according to the invention, and, preferably, a plurality of wireless devices according to the invention.

2. Description of the Related Art

Dual-polarized (cross-polarized) patch-like slot antennas are known. This known antenna comprises a printed circuit board (PCB) acting as substrate, wherein two patches are printed on opposite sides of the substrate. Each patch acts as a separate antenna being independently fed with a coaxial cable. In order to increase the isolation between the two patches, the center of one patch is connected to the ground by means of a shorting post. The known antenna has several disadvantages. A first disadvantage is that the known antenna is quite voluminous and bulky. This makes the known antenna rather expensive, wherein the cost price of the known antenna is further increased due to the three required material layers and due to the required laborious, complicated production process. Moreover, the required shorting post is mechanically vulnerable, and moreover not easy to manufacture. Furthermore, the known antenna structure is not suitable to further improve the antenna for wideband operation, while there is an increasing demand for high data rate in cellular technologies, for example, the new 4G/5G LTE cellular technologies, which requires high performance antenna technologies.

SUMMARY

It is a first object of the invention to provide an improved dual-band directional antenna for use in CPE applications.

It is a second object of the invention to provide an improved wideband antenna for use in CPE applications.

It is a third object of the invention to provide a relatively compact, inexpensive, high gain antenna for operation in two LTE frequency bands, in particular the 1.71-2.7 GHz frequency band and the 3.3-3.8 GHz frequency band.

At least one of these objects is achieved by providing an dual-band antenna according to the preamble, comprising: at least one conductive radiating element, said radiating element enclosing at least one first slot extending in a first direction and a plurality of second slots extending in a second direction perpendicular to the first direction, wherein each outer end of each first slot is connected to at least one second slot, a probing structure connected to said radiating element, a conductive ground plane, at least one mounting element for mounting said at least one radiating element on the ground plane at a distance from said ground plane, and wherein the antenna is preferably configured to operate in two different frequency bands.

The antenna according to the invention has several advantages over the existing dual antenna with cross-polarization described above. A first advantage of the new antenna design according to the invention is that the antenna, in particular each radiating element of the antenna, is designed to act as single antenna rather than as dual antenna. Due to the simple design of the new antenna, wherein the radiating element typically consists of a single conductive layer or plate, typically a metal layer or plate, such as a copper layer or plate, the material costs are reduced, leading to a more favorable price of the antenna. Moreover, the new antenna design allows the antenna to be designed in a relatively compact manner compared to the known antenna, which leads to a further material savings. Additionally, since the production process of the antenna according to the invention is significantly simplified compared to the production process of the existing antennas, the cost price of the antenna can further be reduced. Here, it is noted that the slots may, for example, simply be punched (stamped) into the radiating element during the production process, which leads to a simple and inexpensive manner to provide the slots. An additional advantage is that a complicated, vulnerable central shorting post, as described above in relation to the known antennas, is no longer needed, which not only leads to further economic savings, but will also improve the robustness and hence the reliability and durability of the antenna according to the invention. The new antenna design furthermore allows the antenna to operate in at least two frequency bands, in particular the 1.71-2.7 GHz frequency band and the 3.3-3.8 GHz frequency band. These frequency bands are typically used for Multiple Input Multiple Output ("MIMO") LTE applications. Since the radiating element of the antenna according to the invention is a single-direction, horizontally polarized radiating element, an additional radiating element can be placed immediately next to another radiating element by simply changing the orientation in the same plane, which ensures compact MIMO configuration with a beneficiary high isolation. Here, it is noted that the antenna according to the invention is typically also configured to act as wideband antenna, or even as ultrawideband antenna. Preferably, the antenna according to the invention is configured to be operational in the (wide) frequency band 1865 to 3500 MHz (at −10 dB). In this case, the antenna is configured to operate in overlapping frequency bands allowing the antenna to act as wideband antenna preferably with high-gain characteristics. More in general, the antenna according to the invention may be applied in customer-premise equipment (CPE) applications based upon one or more of the following wireless broadband communication standards: LTE, UMTS, WiMAX, (high-gain) Wi-Fi. Furthermore, the antenna according to the invention is suitable for MIMO LTE applications. The compact size allows the radiation elements of the antenna to be placed closely and reduce the overall size of MIMO antenna systems.

In the antenna according to the invention, the (total) length of the slots, including said at least one first slot and said plurality of second slots, typically determines the higher frequency band ("higher-band") resonance of the antenna. The width of the radiating element typically determines the lower frequency band ("lower-band") resonance of the antenna.

Typically, the ground plane is made of a metal plate, in particular a copper plate. The one or more mounting elements, typically formed by mounting legs, may be made of a conductive material and/or an insulating material. Preferably, each radiating element is mounted by a plurality of mounting elements, typically two mounting elements, to the ground plane. The mounting elements are preferably positioned at outer opposite ends of the radiating element. More preferably, the mounting elements are preferably positioned at outer opposite ends of the radiating element, such that the first slot and second slots are situated in between said mounting elements.

Preferably, at least one radiating element has rounded edges. The edge radius, also referred to as tapering radius, of the radiating element, plays an important role on the matching of the antenna. Depending on the edge radius the low-resonance changes and also the level of matching at higher-band is affected. Experiments show that it is preferred to provide each rounded edge with an edge radius of at least 16 mm.

Typically, the length of the first slot exceeds the length of each second slot. Typically, each radiating element is provided with a single first slot and two second slots. Typically, the length of the first slot exceeds the length of each second slot. Preferably, the length of at least one first slot is at least 49 millimeter, preferably at least 55 millimeter. The length of the first slot of the radiating element plays an important role on the resonance frequency of the higher-band. In addition, the length of the first slot of the radiating element affects the matching level at lower-band. Experiments have shown that a first slot length of (approximately) 58 mm provides the best performance in terms of peak realized gain and total efficiency. The length of the second slots of each radiating element of the antenna plays an important role on the resonance frequency of the higher-band. In addition, the length of the second slots of the antenna affects the matching at lower-band. Experiments have shown that a second slot length of at least 20 millimeter, preferably at least 23 millimeter, leads to the best performance, and is therefore preferred.

Preferably, the width of the first slot is substantially identical to the width of each second slot. The width of the slot of the antenna affects the resonance of both frequency bands of the antenna, wherein narrow slots typically provide narrow a bandwidth. This slot width of the first slot and/or the second slot typically varies from 0.5 to 2 millimeter, and more preferably, the width of at least one slot is at least 1.5 millimeter, preferably at least 2.0 millimeter.

The length of each radiating element plays an important role on the matching of the antenna. It has been found that the length of the radiating element has a minimal effect on the resonance frequencies of (the radiating element of) the antenna. Experiments have shown that it is preferred that the length of at least one radiating element is smaller than or equal to 64 millimeter.

The width of each radiating element plays an important role on the resonance frequency of the lower-band. In addition, the width of the antenna typically affects the matching level at higher-band. Experiments have shown that it is preferred that the width of at least one radiating element is smaller than or equal to the length of said radiating element, and/or that the width of at least one radiating element is at least 56 millimeter.

The distance between each radiating element and the ground plane, also referred to as the height of each radiating element with respect to the ground plane, plays an important role on the matching of the antenna. Experiments show that is favorable and therefore preferred in case the distance between each radiating element and the ground plane is at least 20 millimeter.

Typically, each outer end of each first slot is connected to a central portion, in particular the center, of at least one second slot. This leads to an I-shaped (overall) slot formed by the combination of the first slot and two second slots. Preferably, the first slot and second slots together define an overall slot, wherein said overall slot has a substantially mirror symmetric design. More preferably, said overall slot has at least two axes of symmetry, which axes are typically oriented perpendicular to each other.

In a preferred embodiment according to the invention, at least one radiating element partially encloses at least one first cut-out portion and partially encloses at least one second cut-out portion, wherein said at least one first cut-out portion and said at least one second cut-out portion are positioned at opposite sides of the first slot of said radiating element. Each cut-out portion is typically formed by a recess connected to a peripheral edge of the radiating element. The cut-out portion divides a side of the radiating element into two segments, also referred to as branches. The cut-out portion may be realized by a simple punch action during production, wherein original material of the radiating element is removed from the radiating element. Preferably, each cut-out portion is partially surrounded by the first slot and the second slots.

The cut-out portions may have various shapes. The first cut-out portion(s) and the second cut-out portion(s) may have designs and/or dimensions which are either identical to each other or distinctive from each other. Preferably, the cut-out portions are identical to each other and positioned symmetrically with respect to the first slot. Preferably, at least one cut-out portion comprises a substantially rectangular base portion facing the first slot. The rectangular base portion may extend to the peripheral edge, which may lead to a rectangularly shaped cut-out portion. At least one cut-out portion typically comprises a lower wall which faces the first slot and which is substantially parallel to the first slot. It is in particular beneficial if at least one cut-out portion comprises opposite side walls, wherein at least one distal end of at least one side wall is directed towards an opposing distal end of an opposing side wall. Preferably, the distal ends of both said opposite side walls are directed towards another. Due to one or more distal ends of the opposite side walls of at least one cut-out portion, and preferably all cut-out portions, being directed towards another, the effective length of the branches of the radiating element can be increased, and the distance between the branches can be kept limited, which facilitates a desired coupling between opposing branches being separated by a cut-out portion. In this manner, the guidance of the current flow in a desired direction can be facilitated in a rather efficient manner in order to allow the antenna to function as dual-band antenna with two distinctive frequency bands. By modifying the orientation and/or shape of the side walls, optionally a wideband antenna functionality can be obtained wherein the low frequency band overlap more drastically with the high frequency band. Also this kind of wideband antenna is considered as dual-band antenna in the context of this patent document. It is also conceivable that each of the first and the second cut-out portions comprises opposite side walls, wherein at least one distal end of at least one side wall is directed towards an opposing distal end of an opposing side wall. Where it is said that the distal ends of the opposite side walls are directed to another, it can also be said that the tips, or tip regions, of the opposing branches are directed to another, wherein each tip or tip region is defined by a peripheral wall part of the radiating element and an adjacent distal end of a side wall of the cut-out portion. Each cut-out portion preferably has a symmetrical shape, such as a trapezoid shape, in particular an isosceles trapezoid shape. In this trapezoid shape a trapezoid base is positioned close to the first slot of the radiating element, and two opposing legs connecting to said base converge in a direction away from said base. Said legs can be considered as side walls of the cut-out portion. The side walls of the cut-out portion can have a linear shape and/or a curved shape and/or an angled shape. Different side wall segments may more have different shapes and/or different orientations. For example, a proximal end of each side wall, positioned relatively close to the first slot of the radiating element, may have a linear shape and may have an orientation substantially perpendicular to the orientation of the first slot, while a connecting distal end of said side wall may enclose an angle with the direction in which said proximal end extends. This angle may for example be situated between 15 and 60 degrees, more in particular between 15 and 30 degrees, as for example shown in FIG. 1*b*. The converging orientation of the side walls of a cut-out portion in a direction away from the first slot reduces the height of said cut-out portion, as measured from side wall to side wall, and thereby enlarges the effective length (or width) of the branches defined by said cut-out portion, which is favourable to allow the antenna to operate within the desired low frequency band.

In a preferred embodiment, at least one cut-out portion comprises opposite side walls, which side walls are at least partially chamfered (tapered or inclined) with respect to each other. It is also preferred that the opposite side walls substantially face another. It has been found that the application of chamfered side walls influences the matching of the antenna. The chamfered side walls typically increases or decreases the overall (effective) width of the radiating element, and hence changes the resonance frequency at lower band, wherein it may also affect the matching level at higher-band. More preferably, the at least one cut-out portion comprises opposite side walls, which side walls are at least partially chamfered towards each other (hence converging) in a direction away from the first slot. More preferably, each chamfered side wall encloses a chamfer angle with a normal perpendicular to the first slot which is equal to or less than 25 degrees. Hence, the chamfer angle is preferably kept limited.

At least one cut-out portion typically comprises an access opening. The access opening may be substantially enclosed by and/or defined by the distal ends of the opposite side walls of the cut-out portion. Preferably, the distance between the distal ends of the opposite side walls of at least one cut-out portion is smaller than the distance defined by a distance between the opposite side wall considered at a (predetermined) distance from said distal ends, which will improve electromagnetic coupling between opposing branches of the radiating element, and as defined by the cut-out portion. It is also conceivable that at least one cut-out portion has its smallest distance, or diameter, at the access opening of the cut-out portion. Said distance being considered in a direction substantially parallel to the longitudinal direction of the first slot.

Preferably, the probing structure comprises a coaxial cable acting connected to a radiating element. Different conductors of the coaxial cable are typically connected to different sides of the first slot.

In a preferred embodiment, the antenna comprises a plurality of radiating elements, preferably four radiating elements, mounted onto said (single, shared) ground plane. More preferably, each radiating element is connected to a separate antenna port. This configuration makes the antenna well suitable for MIMO applications, in particular MIMO LTE applications. Preferably, each radiating element is a wideband radiator which covers the complete frequency band between 1700 MHz and 3800 MHz Preferably, the antenna structure is integrated within a volume of 200 millimeter (length)×120 millimeter (width)×21.7 millimeter (height). The maximal antenna height is preferably 21.7 millimeter. Preferably, the antenna is accommodated within an antenna housing.

The invention also relates to a radiating element for use in an antenna according to the invention. The radiating element is also referred to as "antenna element" as it actually functions as antenna (once mounted on the ground plane).

The invention further relates to a wireless device for customer-premise equipment (CPE) applications, such as a wireless access points (AP), a router, a gateway, and/or a bridge, comprising at least one antenna according to one of the foregoing claims.

The invention additionally relates to a wireless communication system, comprising a plurality of antennas according to the invention, and, preferably, a plurality of wireless devices according to the invention. More preferably, the system according to the invention comprises a plurality of antennas according to the invention, wherein said system is configured as Multiple-Input, Multiple-Output ("MIMO") antenna system. Since each radiating element is a single-direction horizontally polarized radiating element, an additional radiating element can be placed immediately next to it by changing the orientation in the same plane (defined by the radiating elements), which ensures a desired compact MIMO configuration with a relatively high isolation.

The invention will be elucidated on the basis of the following non-limitative clauses.

1. Dual-band directional antenna, in particular for customer-premise equipment (CPE) applications, comprising:
   - at least one conductive radiating element, said radiating element enclosing at least one first slot extending in a first direction and a plurality of second slots extending in a second direction perpendicular to the first direction, wherein each outer end of each first slot is connected to at least one second slot,
   - a probing structure connected to said radiating element,
   - a conductive ground plane,
   - at least one mounting element for mounting said at least one radiating element on the ground plane at a distance from said ground plane, and wherein the antenna is configured to operate in two different frequency bands.

2. Antenna according to clause 1, wherein the antenna is configured to operate in overlapping frequency bands allowing the antenna to act as wideband antenna with high-gain characteristics.

3. Antenna according to clause 1 or 2, wherein at least one radiating element is a formed by a conductive plate.

4. Antenna according to one of the foregoing clauses, wherein at least one radiating element has rounded edges.

5. Antenna according to clause 4, wherein each rounded edge has an edge radius of at least 16 mm.

6. Antenna according to one of the foregoing clauses, wherein at least one radiating element is substantially made from metal.

7. Antenna according to one of the foregoing clauses, wherein each radiating element is provided with a single first slot and two second slots.

8. Antenna according to one of the foregoing clauses, wherein the length of the first slot exceeds the length of each second slot.

9. Antenna according to one of the foregoing clauses, wherein the width of the first slot is substantially identical to the width of each second slot.

10. Antenna according to one of the foregoing clauses, wherein the length of at least one radiating element smaller than or equal to 64 millimeter.

11. Antenna according to one of the foregoing clauses, wherein the width of at least one radiating element is smaller than or equal to the length of said radiating element, and wherein said width is at least 56 millimeter.

12. Antenna according to one of the foregoing clauses, wherein the length of at least one first slot is at least 49 millimeter, preferably at least 55 millimeter.

13. Antenna according to one of the foregoing clauses, wherein the width of at least one first slot is at least 1.5 millimeter, preferably at least 2.0 millimeter.

14. Antenna according to one of the foregoing clauses, wherein the length of at least one second slot is at least 20 millimeter, preferably at least 23 millimeter.

15. Antenna according to one of the foregoing clauses, wherein the distance between each radiating element and the ground plane is at least 20 millimeter.

16. Antenna according to one of the foregoing clauses, wherein each outer end of each first slot is connected to a central portion of at least one second slot.

17. Antenna according to one of the foregoing clauses, wherein the first slot and second slots together define an overall slot, wherein said overall slot has a substantially mirror symmetric design.

18. Antenna according to clause 17, wherein said overall slot has an I-shaped design.

19. Antenna according to clause 17 or 18, wherein said overall slot has at least two axes of symmetry.

20. Antenna according to one of the foregoing clauses, wherein at least one radiating element partially encloses at least one first cut-out portion and partially encloses at least one second cut-out portion, wherein said at least one first cut-out portion and said at least one second cut-out portion are positioned at opposite sides of the first slot of said radiating element.

21. Antenna according to clause 20, wherein each cut-out portion is partially surrounded by the first slot and the second slots.

22. Antenna according to one of clauses 20-21, wherein at least one cut-out portion has a rectangular shape.

23. Antenna according to one of clauses 20-22, wherein at least one cut-out portion comprises a substantially rectangular base portion facing the first slot.

24. Antenna according to one of clauses 20-23, wherein at least one cut-out portion comprises a lower wall which faces the first slot and which is substantially parallel to the first slot.

25. Antenna according to one of clauses 20-24, wherein at least one cut-out portion comprises opposite side walls, which side walls are at least partially chamfered.

26. Antenna according to clause 25, wherein at least one cut-out portion comprises opposite side walls, which side walls are at least partially chamfered towards each other in a direction away from the first slot.

27. Antenna according to clause 23 and clause 26, wherein at least one cut-out portion comprises a substantially rectangular base portion facing the first slot, wherein said base portion connects to opposite side walls of the cut-out portion connecting the cut-out portion to a peripheral edge of the radiating element, wherein the side walls are at least partially chamfered towards each other in a direction away from the first slot.

28. Antenna according to clause 26 or 27, wherein each chamfered side wall encloses a chamfer angle with a normal perpendicular to the first slot which is equal to or less than 25 degrees.

29. Antenna according to one of clauses 20-28, wherein each cut-out portion connects to a peripheral edge of the radiating element.

30. Antenna according to one of the foregoing clauses, wherein the antenna comprises a plurality of mounting elements, wherein each radiating element is mounted by means of a plurality of mounting elements to the ground plane.

31. Antenna according to one of the foregoing clauses, wherein the antenna is configured to operate both in a first frequency band of 1.71-2.7 GHz and a second frequency band of 3.3-3.8 GHz.

32. Antenna according to one of the foregoing clauses, wherein the antenna is configured to act as one of the following antenna types: LTE antenna, UMTS antenna, WiMAX antenna, high-gain Wi-Fi antenna.

33. Antenna according to one of the foregoing clauses, wherein the probing structure comprises a coaxial cable acting connected to a radiating element.

34. Antenna according to one of the foregoing clauses, wherein the slots are punched into each radiating element.

35. Antenna according to one of the foregoing clauses, wherein the antenna comprises a plurality of radiating elements mounted onto said ground plane.

36. Radiating element for use in an antenna according to one of the foregoing clauses.

37. Wireless device for customer-premise equipment (CPE) applications, such as a wireless access points (AP), a router, a gateway, and/or a bridge, comprising at least one antenna according to clauses 1-35.

38. Wireless communication system, comprising a plurality of antennas according to one of clauses 1-35, and, preferably, a plurality of wireless devices according to clause 37.

39. System according to clause 38, wherein said system comprises a plurality of antennas according to clause 35, and wherein said system is configured as Multiple-Input, Multiple-Output ("MIMO") antenna system.

The invention will be elucidated on the basis of non-limitative exemplary embodiments shown in the enclosed figures. In these embodiments, similar reference signs correspond to similar or equivalent features or elements.

DETAILED DESCRIPTION OF THE PREFERRED EMBODIMENTS

Figure 1A:
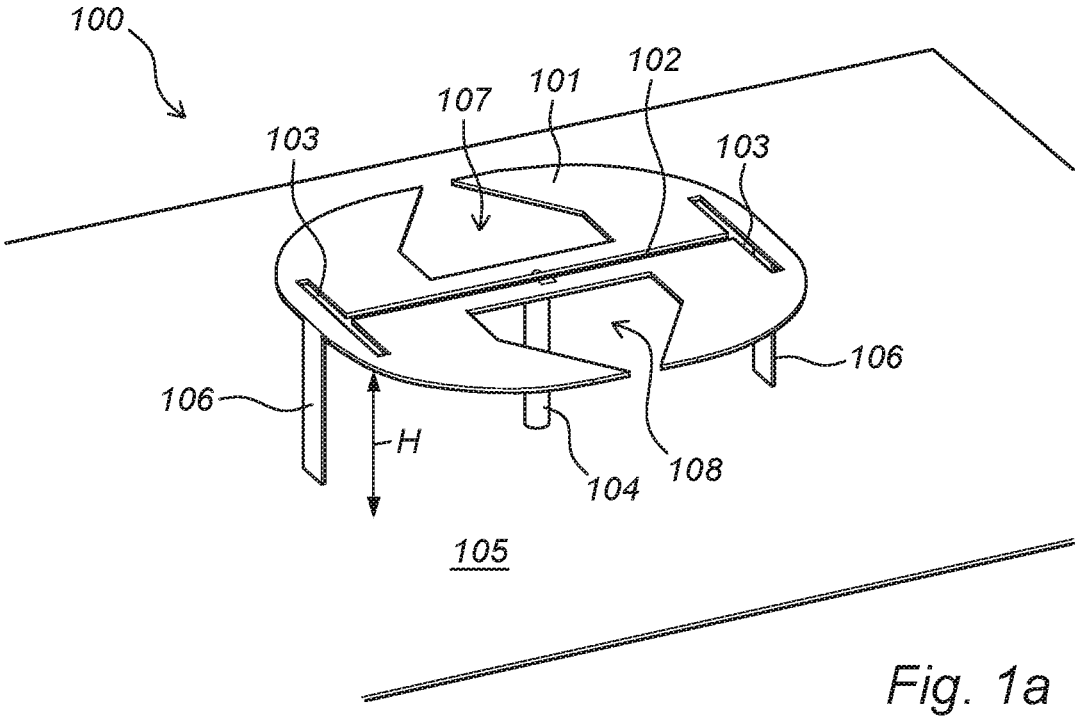
FIG. 1*a* is a perspective view of a dual-band antenna for customer-premise equipment (CPE) applications.
Figure 1B:
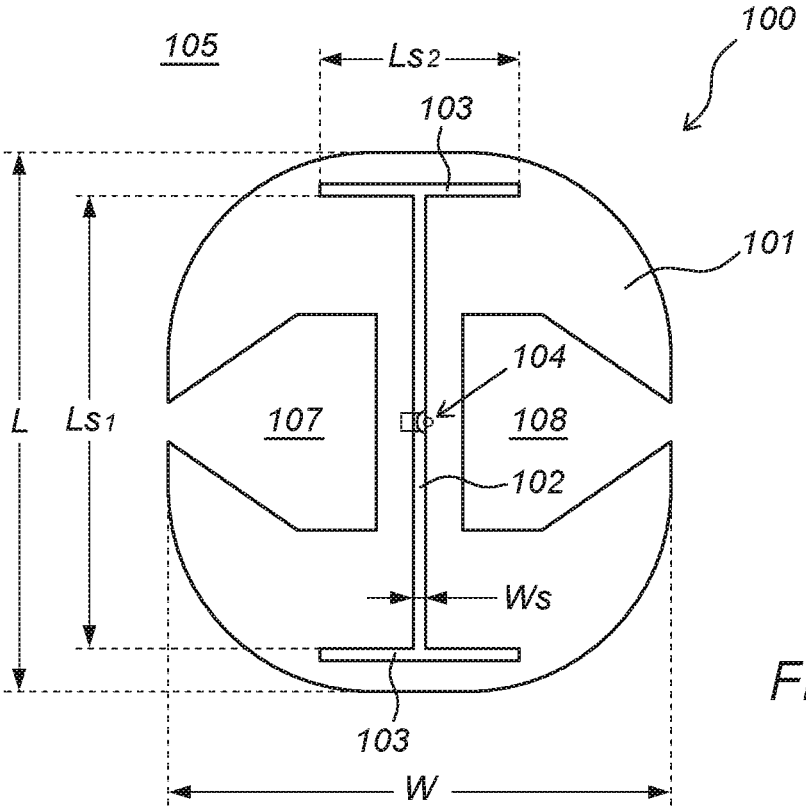
FIG. 1*b* is a plan view of the dual-band antenna for customer-premise equipment (CPE) applications.

FIG. 1*a* shows a perspective view of a dual-band antenna (100) for customer-premise equipment (CPE) applications according to the present invention. FIG. 1*b* shows a top view of the antenna (100) as shown in FIG. 1*a*. The antenna (100) comprises a conductive radiating element (101). The radiating element (101) encloses a first slot (102) extending in a first direction and two second slots (103) extending in a second direction perpendicular to the first direction. Each outer end of the first slot (102) is connected to a second slot (103). The antenna (100) further comprises a probing structure (104) connected to the radiating element (101), a conductive ground plane (105) and two mounting elements (106) for mounting the radiating element (101) on the ground plane (105) at a distance from said ground plane (105). The antenna (100) is configured to operate in two different frequency bands. The radiating element (101) partially encloses a first cut-out portion (107) and partially encloses a second cut-out portion (108). The first cut-out portion (107) and the second cut-out portion (108) are positioned at opposite sides of the first slot (102) of the radiating element (101).

The parameters which are used in the simulation shown in the further figures are indicated in FIGS. 1*a* and 1 *b*. Hence, the length L and width W of the radiating element (101), the length Lslot1 of the first slot (102), the length Lslot2 of the second slot (103), the height H of the mounting element and the slot width Wslot are specified.

Figure 2A:
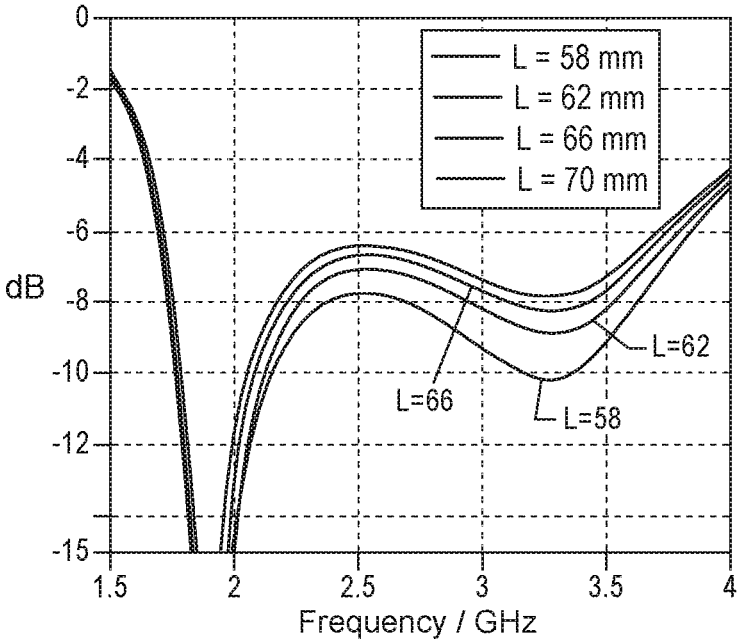
FIG. 2*a* is a graph showing the magnitude of the input reflection coefficient (in dB) of the dual-band antenna for customer-premise equipment (CPE) applications.

FIG. 2*a* shows a graph presenting the magnitude of the input reflection coefficient in dB of an antenna as shown in FIGS. 1*a* and 1*b*. The x-axis shows the frequency in GHz, the y-axis shows the magnitude of the input reflection coefficient in dB. The length L of the radiating element is varied. The influence of the length of the radiating element on the magnitude of the input reflection coefficient in dB can be observed in the graph. The best performance was observed for L is 58 mm.

Figure 2B:
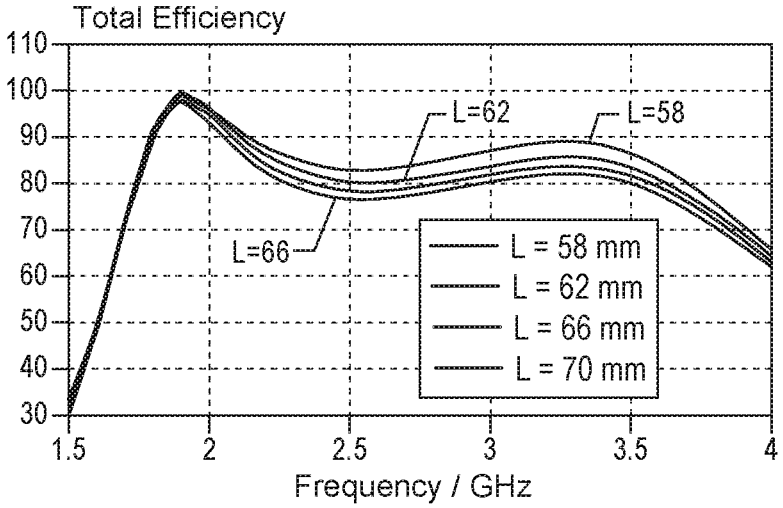
FIG. 2*b* is a graph showing the total efficiency (in %) of the dual-band antenna for customer-premise equipment (CPE) applications.
Figure 2C:
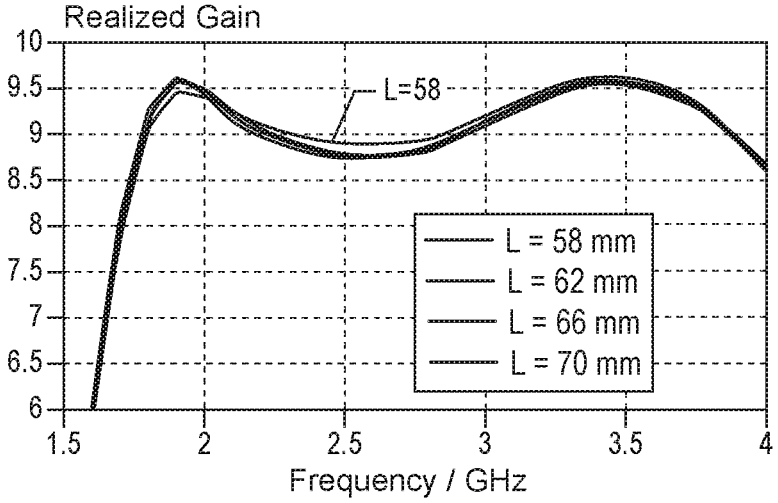
FIG. 2*c* is a graph showing the antenna peak realized gain (in dBi) of the dual-band antenna for customer-premise equipment (CPE) applications.

FIG. 2*b* shows a graph indicating the total efficiency in percentage of an antenna according to the present invention. The x-axis shows the frequency in GHz. FIG. 2*c* shows a graph of the antenna peak realized gain in dBi. Again, the x-axis shows the frequency in GHz.

Figure 3A:
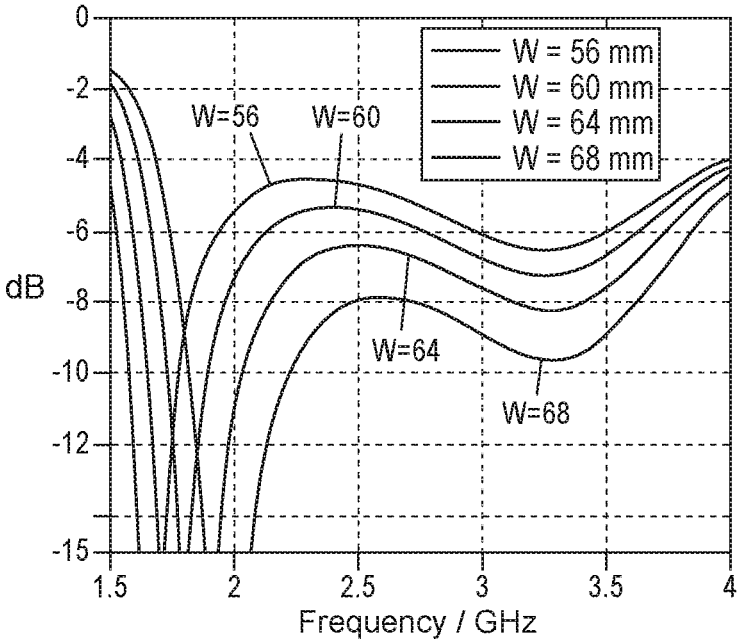
FIG. 3*a* is a graph showing the magnitude of the input reflection coefficient (in dB) of the dual-band antenna for customer-premise equipment (CPE) applications.

FIG. 3*a* shows a graph presenting the magnitude of the input reflection coefficient in dB of an antenna as shown in FIGS. 1*a* and 1*b*. The x-axis shows the frequency in GHz, the y-axis shows the magnitude of the input reflection coefficient in dB. The width W of the radiating element is varied. The influence of the width of the radiating element on the magnitude of the input reflection coefficient in dB can be observed in the graph. The best performance was observed for W is 68 mm.

Figure 3B:
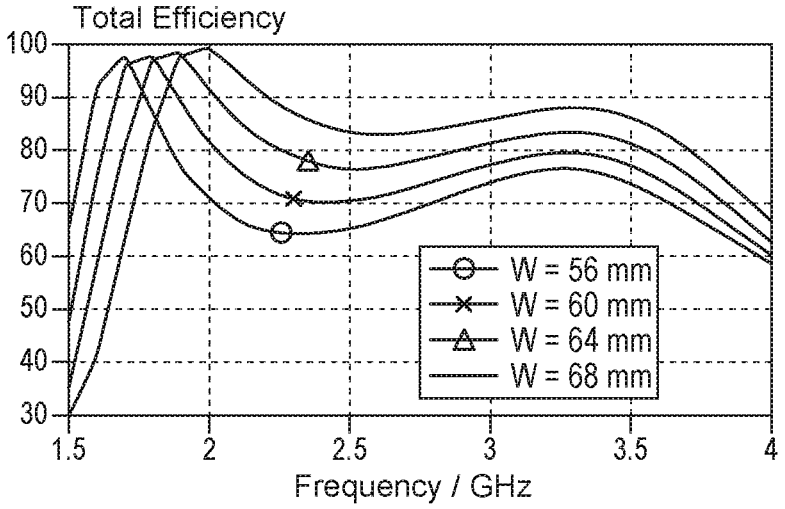
FIG. 3*b* is a graph showing the total efficiency (in %) of the dual-band antenna for customer-premise equipment (CPE) applications.
Figure 3C:
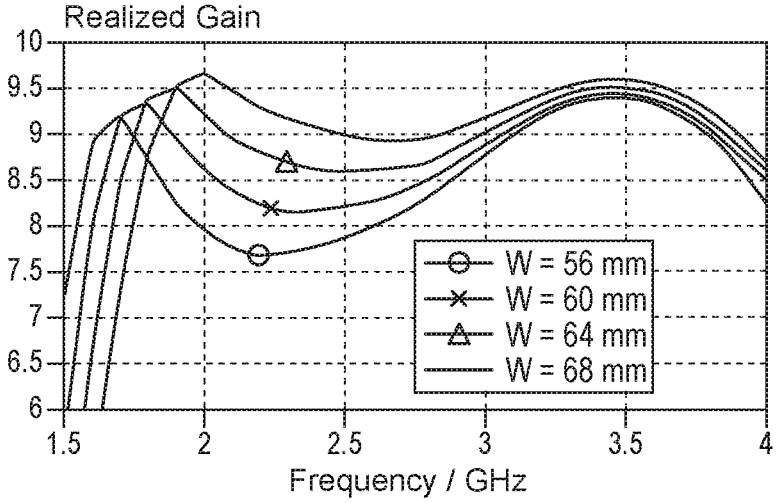
FIG. 3*c* is a graph showing the antenna peak realized gain (in dBi) of the dual-band antenna for customer-premise equipment (CPE) applications.

FIG. 3*b* shows a graph indicating the total efficiency in percentage of an antenna according to the present invention. The x-axis shows the frequency in GHz. FIG. 3*c* shows a graph of the antenna peak realized gain in dBi. Again, the x-axis shows the frequency in GHz.

Figure 4A:
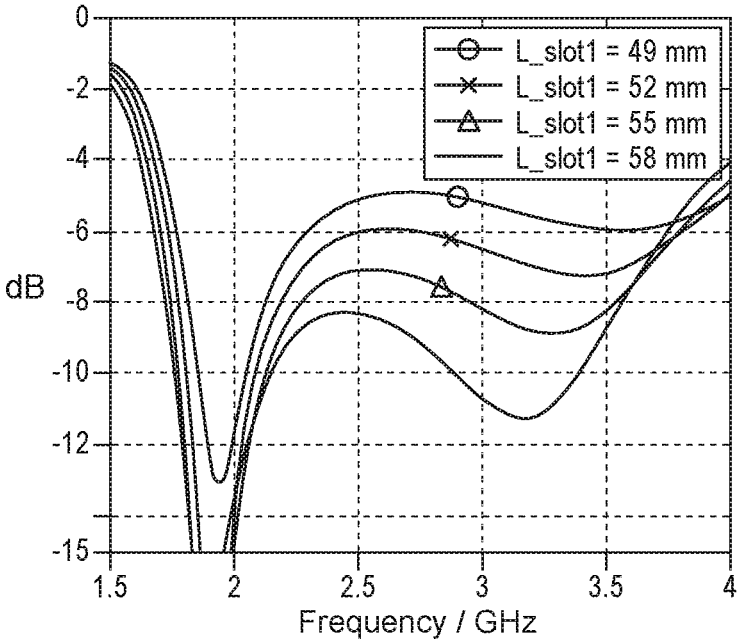
FIG. 4*a* is a graph showing the magnitude of the input reflection coefficient (in dB) of the dual-band antenna for customer-premise equipment (CPE) applications.

FIG. 4*a* shows a graph presenting the magnitude of the input reflection coefficient in dB of an antenna as shown in FIGS. 1*a* and 1*b*. The x-axis shows the frequency in GHz, the y-axis shows the magnitude of the input reflection coefficient in dB. The length Lslot1 of the first slot is varied. The influence of parameter changes of the length of the first slot can be observed in the graph. The best performance was observed for Lslot1 is 58 mm.

Figure 4B:
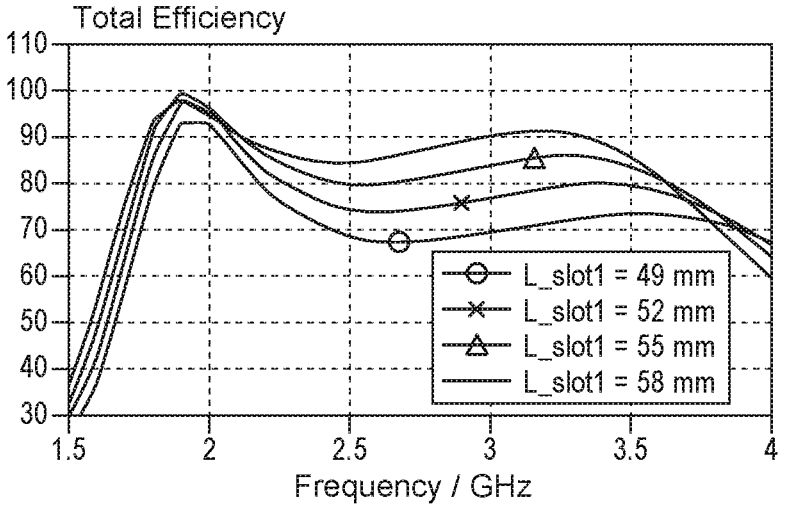
FIG. 4*b* is a graph showing the total efficiency (in %) of the dual-band antenna for customer-premise equipment (CPE) applications.
Figure 4C:
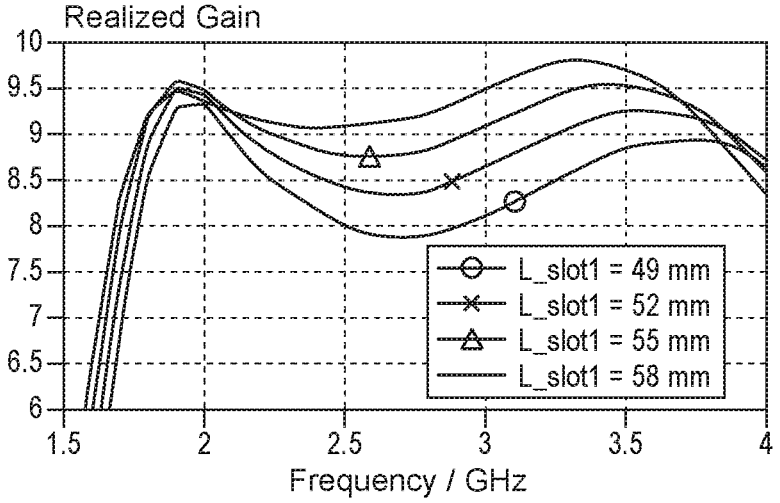
FIG. 4*c* is a graph showing the antenna peak realized gain (in dBi) of the dual-band antenna for customer-premise equipment (CPE) applications.

FIG. 4*b* shows a graph indicating the total efficiency in percentage of an antenna according to the present invention. The x-axis shows the frequency in GHz. FIG. 4*c* shows a graph of the antenna peak realized gain in dBi. Again, the x-axis shows the frequency in GHz.

Figure 5A:
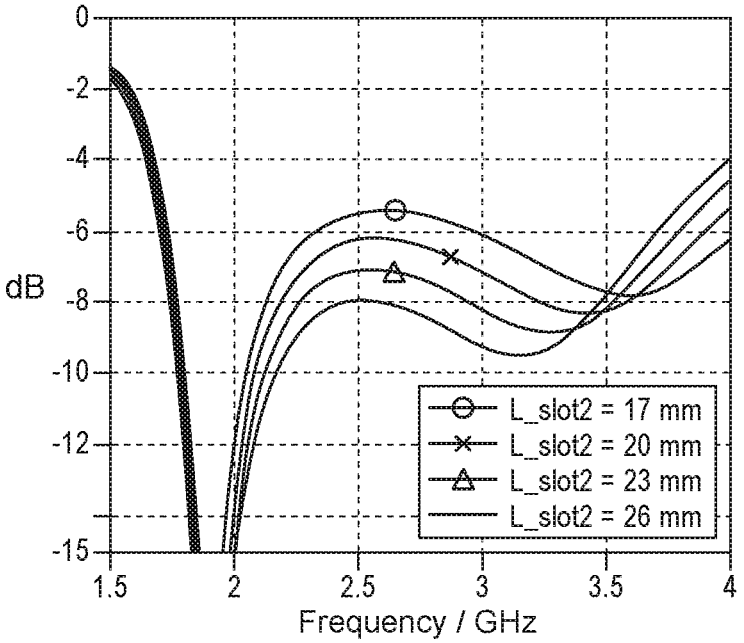
FIG. 5*a* is a graph showing the magnitude of the input reflection coefficient (in dB) of the dual-band antenna for customer-premise equipment (CPE) applications.

FIG. 5*a* shows a graph presenting the magnitude of the input reflection coefficient in dB of an antenna as shown in FIGS. 1*a* and 1*b*. The x-axis shows the frequency in GHz, the y-axis shows the magnitude of the input reflection coefficient in dB. The length Lslot2 of the second slots is varied. The influence of parameter changes of the length of the second slots can be observed in the graph.

Figure 5B:
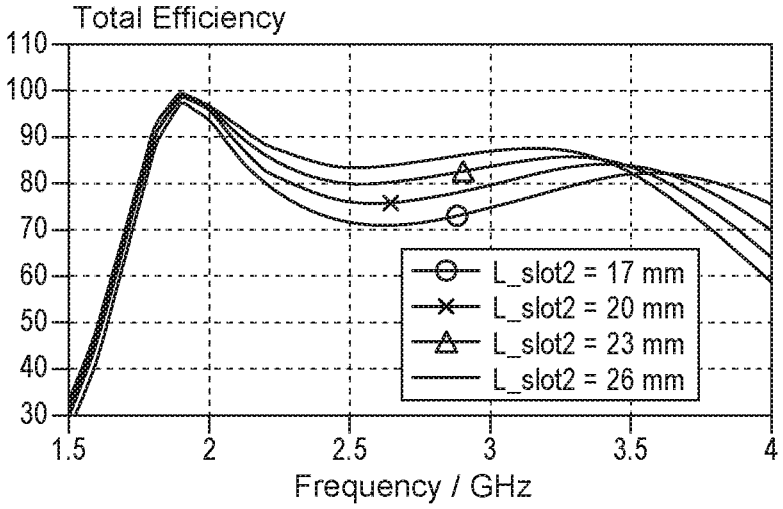
FIG. 5*b* is a graph showing the total efficiency (in %) of the dual-band antenna for customer-premise equipment (CPE) applications.
Figure 5C:
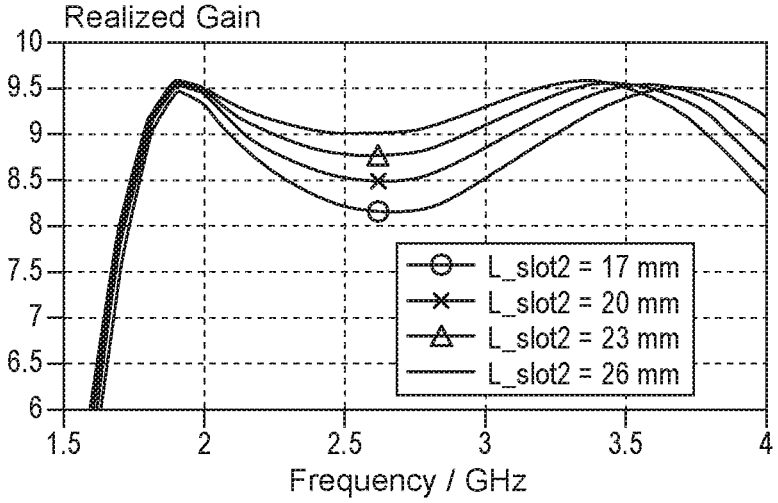
FIG. 5*c* is a graph showing the antenna peak realized gain (in dBi) of the dual-band antenna for customer-premise equipment (CPE) applications.

FIG. 5*b* shows a graph indicating the total efficiency in percentage of an antenna according to the present invention. The x-axis shows the frequency in GHz. FIG. 5*c* shows a graph of the antenna peak realized gain in dBi. Again, the x-axis shows the frequency in GHz.

Figure 6A:
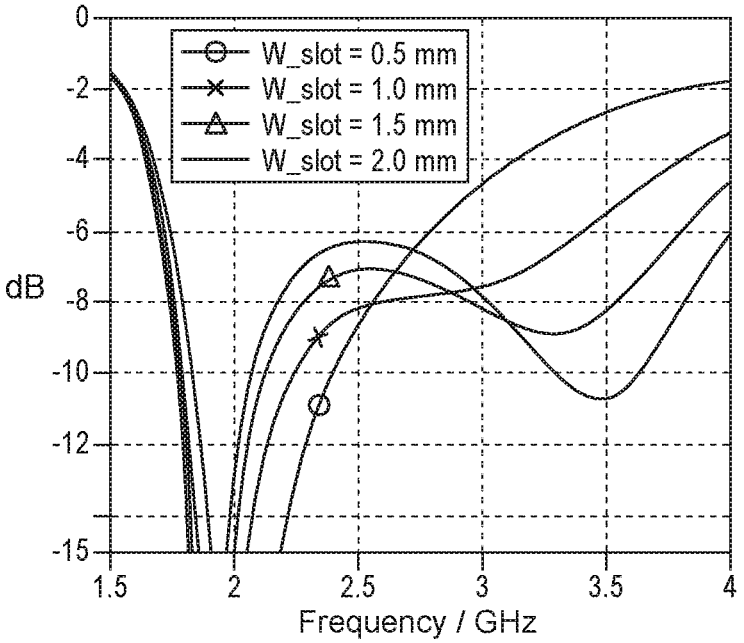
FIG. 6*a* is a graph showing the magnitude of the input reflection coefficient (in dB) of the dual-band antenna for customer-premise equipment (CPE) applications.

FIG. 6*a* shows a graph presenting the magnitude of the input reflection coefficient in dB of an antenna as shown in FIGS. 1*a* and 1*b*. The x-axis shows the frequency in GHz, the y-axis shows the magnitude of the input reflection coefficient in dB. The width of the slots is varied. The influence of parameter changes of the width Wslot of the slots can be observed in the graph.

Figure 6B:
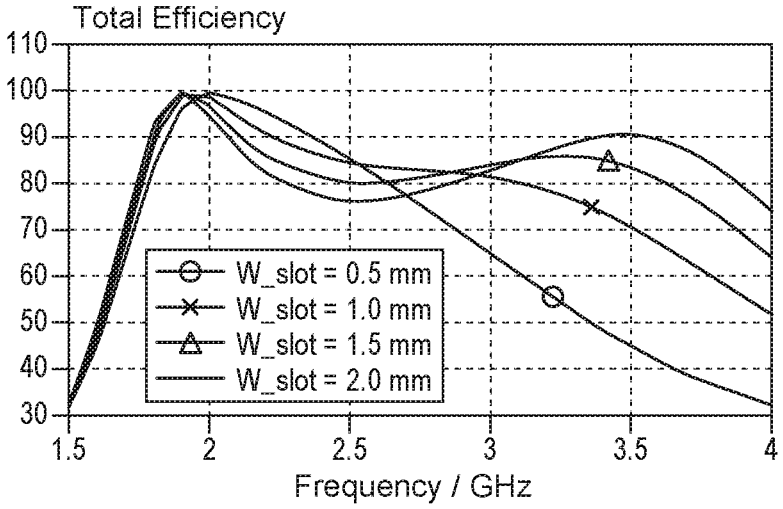
FIG. 6*b* is a graph showing the total efficiency (in %) of the dual-band antenna for customer-premise equipment (CPE) applications.
Figure 6C:
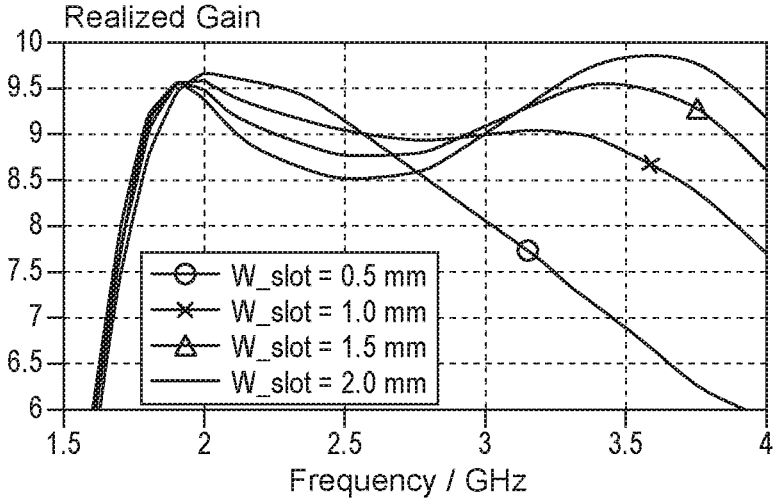
FIG. 6*c* is a graph showing the antenna peak realized gain (in dBi) of the dual-band antenna for customer-premise equipment (CPE) applications.
Figure 7A:
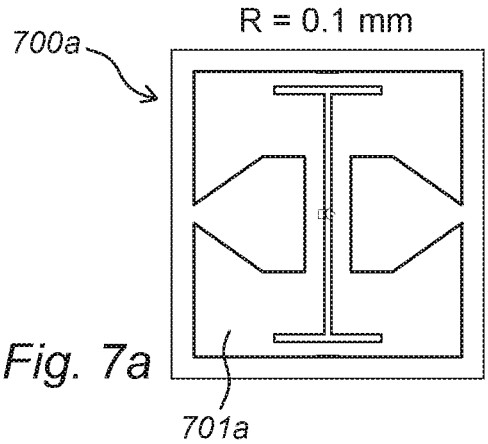
FIG. 7*a* is a plan view of an alternative embodiment of the dual-band antenna for customer-premise equipment (CPE) applications.
Figure 7B:
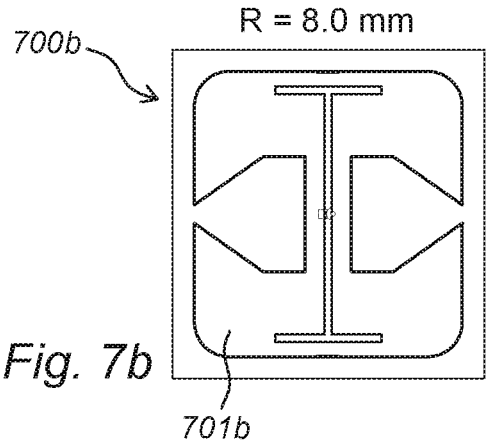
FIG. 7*b* is a plan view of another alternative embodiment of the dual-band antenna for customer-premise equipment (CPE) applications.
Figure 7C:
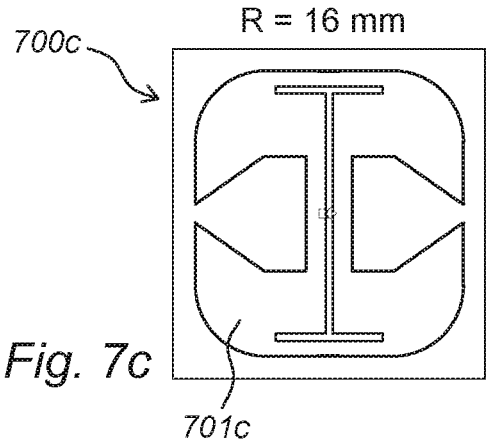
FIG. 7*c* is a plan view of another alternative embodiment of the dual-band antenna for customer-premise equipment (CPE) applications.
Figure 7D:
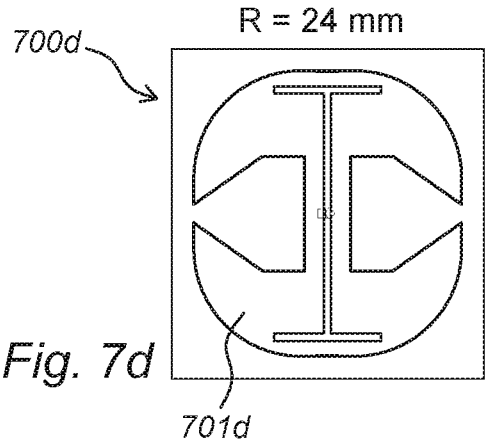
FIG. 7*d* is a plan view of another alternative embodiment of the dual-band antenna for customer-premise equipment (CPE) applications.
Figure 7E:
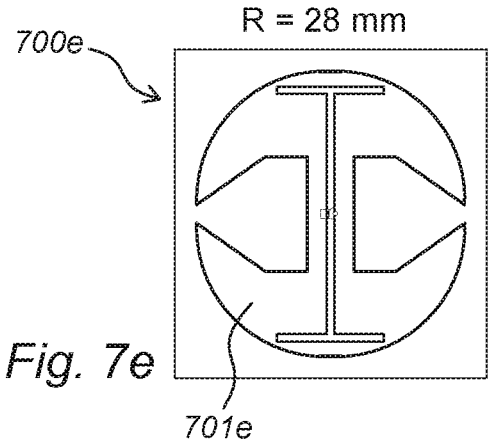
FIG. 7*e* is a plan view of another alternative embodiment of the dual-band antenna for customer-premise equipment (CPE) applications.

FIG. 6*b* shows a graph indicating the total efficiency in percentage of an antenna according to the present invention. The x-axis shows the frequency in GHz. FIG. 6*c* shows a graph of the antenna peak realized gain in dBi. Again, the x-axis shows the frequency in GHz.

FIGS. 7*a*-7*e* show different possible embodiments of antennas (700*a*, 700*b*, 700*c*, 700*d*, 700*e*) according to the present invention. The figure in particular shows the influence of the tapering radius Ron the shape of the radiating element (701*a*, 701*b*, 701*c*, 701*d*, 701*e*) of the antenna (700*a*, 700*b*, 700*c*, 700*d*, 700*e*). It can be seen that each radiating element (701*a*, 701*b*, 701*c*, 701*d*, 701*e*) comprises cut-out portions wherein each cut-out portion comprises opposite chamfered side walls and an access opening. The access openings is in the shown embodiments are defined by the distal ends of the opposite side walls of the cut-out portion. The distance between the distal ends of the opposite side walls of the cut-out portions is smaller than the distance defined by a distance between the opposite side wall considered at a predetermined distance from said distal ends.

Figure 8A:
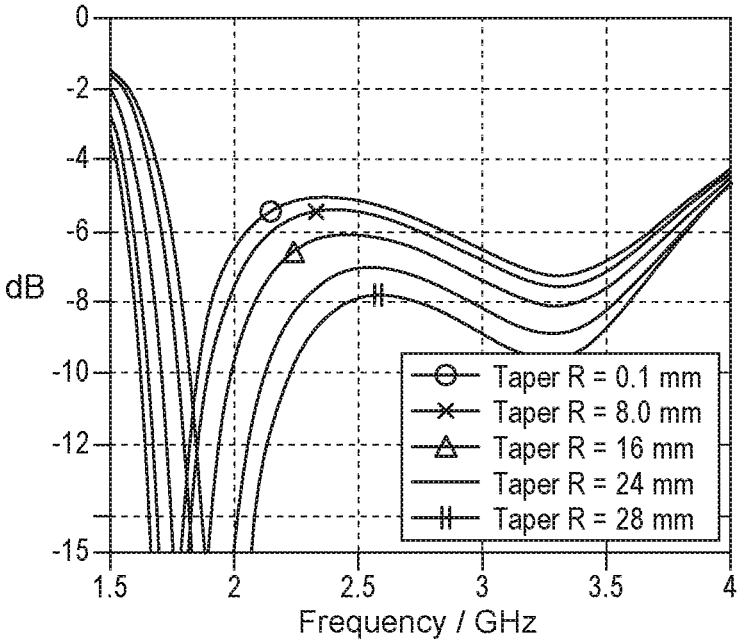
FIG. 8*a* is a graph showing the magnitude of the input reflection coefficient (in dB) of each of the dual-band antennas for customer-premise equipment (CPE) applications of FIGS. 7*a*-7*e*.

FIG. 8*a* shows a graph presenting the magnitude of the input reflection coefficient in dB of an antenna as shown in FIGS. 7*a*-7*e*. The x-axis shows the frequency in GHz, the y-axis shows the magnitude of the input reflection coefficient in dB. The tapering radius is varied. The influence of parameter changes of tapering radius of the radiating element can be observed in the graph.

Figure 8B:
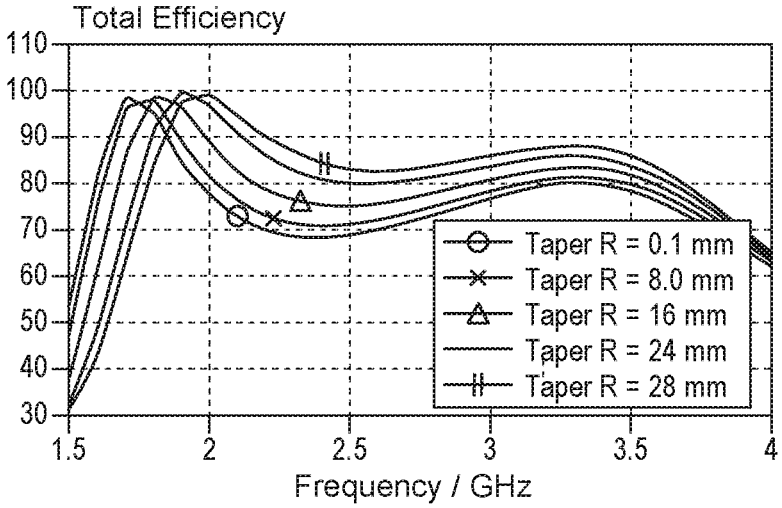
FIG. 8*b* is a graph showing the total efficiency (in %) of each of the dual-band antennas for customer-premise equipment (CPE) applications of FIGS. 7*a*-7*e*.
Figure 8C:
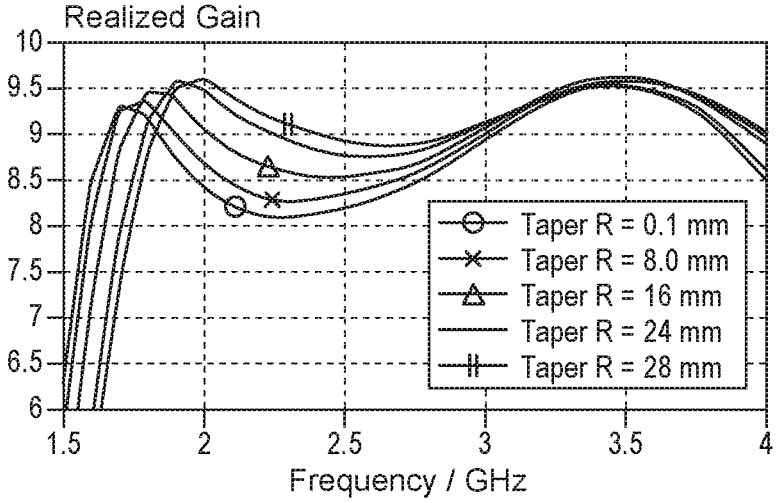
FIG. 8*c* is a graph showing the antenna peak realized gain (in dBi) of each of the dual-band antennas for customer-premise equipment (CPE) applications of FIGS. 7*a*-7*e*.

FIG. 8*b* shows a graph indicating the total efficiency in percentage of an antenna according to the present invention. The x-axis shows the frequency in GHz. FIG. 8*c* shows a graph of the antenna peak realized gain in dBi. Again, the x-axis shows the frequency in GHz.

Figure 9A:
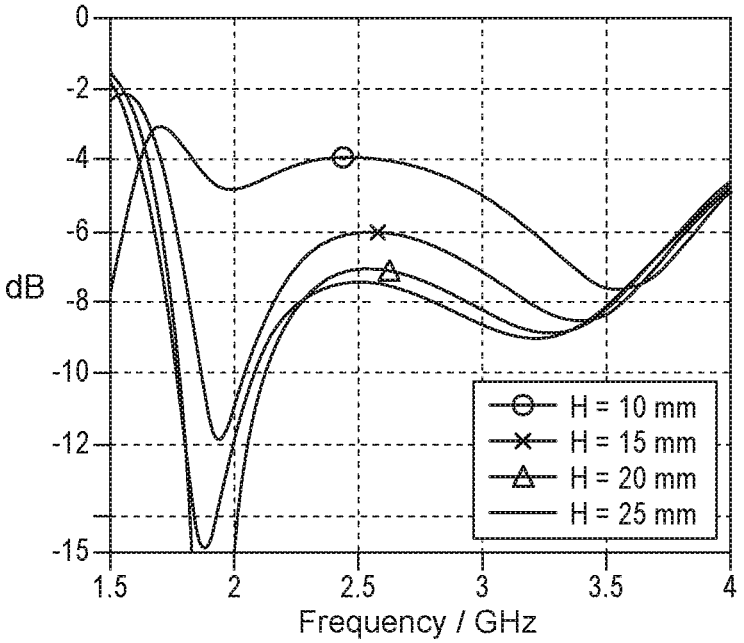
FIG. 9*a* is a graph showing the magnitude of the input reflection coefficient (in dB) of the dual-band antenna for customer-premise equipment (CPE) applications of FIGS. 1*a* and 1*b*.

FIG. 9*a* shows a graph presenting the magnitude of the input reflection coefficient in dB of an antenna as shown in FIGS. 1*a* and 1*b*. The x-axis shows the frequency in GHz, the y-axis shows the magnitude of the input reflection coefficient in dB. The height H of the mounting element is varied, and hence the distance between the radiating element and the ground plane. The influence of the height of the mounting element on the magnitude of the input reflection coefficient in dB can be observed in the graph. It is found that a height H smaller than 15 mm does not provide desired results.

Figure 9B:
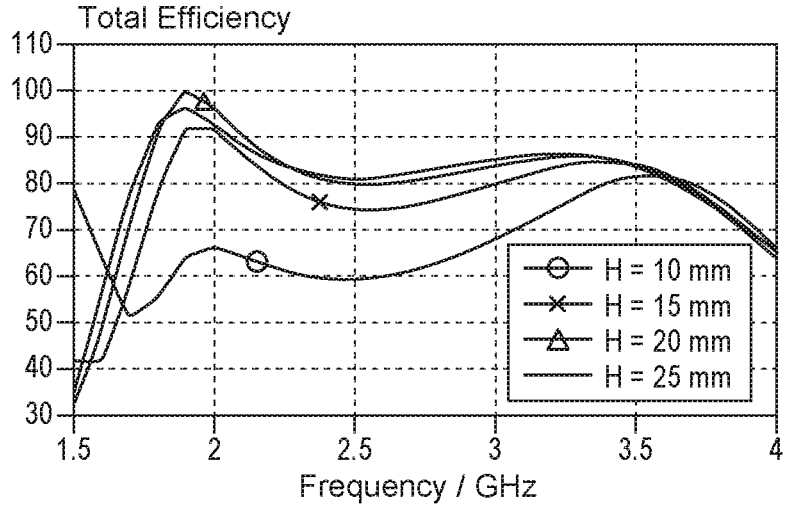
FIG. 9*b* is a graph showing the total efficiency (in %) of the dual-band antenna for customer-premise equipment (CPE) applications of FIGS. 1*a* and 1*b*.
Figure 9C:
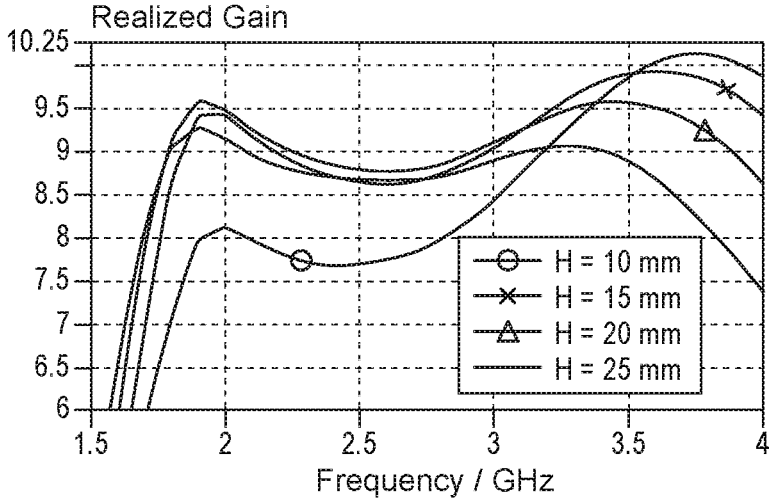
FIG. 9*c* is a graph showing the antenna peak realized gain (in dBi) of the dual-band antenna for customer-premise equipment (CPE) applications of FIGS. 1*a* and 1*b*.

FIG. 9*b* shows a graph indicating the total efficiency in percentage of an antenna according to the present invention. The x-axis shows the frequency in GHz. FIG. 9*c* shows a graph of the antenna peak realized gain in dBi. Again, the x-axis shows the frequency in GHz.

Figure 10A:
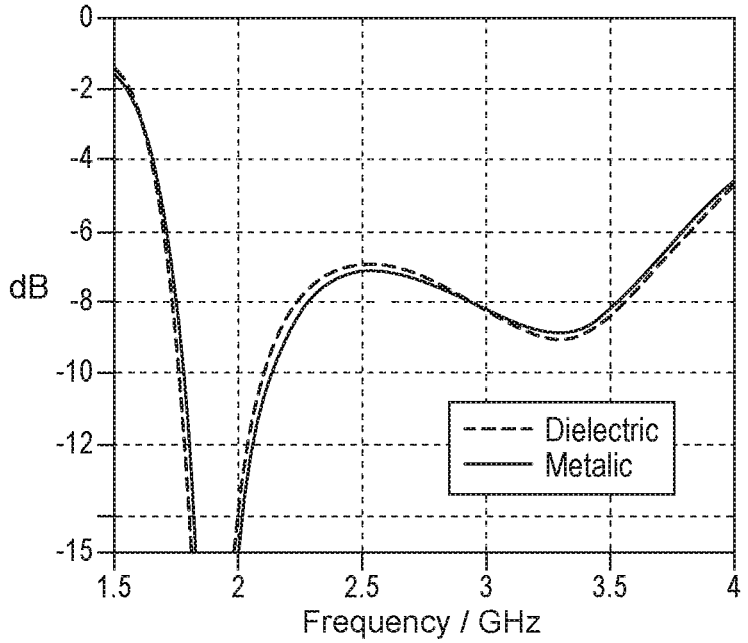
FIG. 10*a* is a graph showing the magnitude of the input reflection coefficient (in dB) of the dual-band antenna for customer-premise equipment (CPE) applications of FIGS. 1*a* and 1*b*.

FIG. 10*a* shows a graph presenting the magnitude of the input reflection coefficient in dB of an antenna as shown in FIGS. 1*a* and 1 *b*. The x-axis shows the frequency in GHz, the y-axis shows the magnitude of the input reflection coefficient in dB. The material of the mounting element is varied, respectively a metallic and a dielectric mounting element are used. It can be observed that replacing a metallic mounting element by a dielectric mounting element does not affect the antenna performance.

Figure 10B:
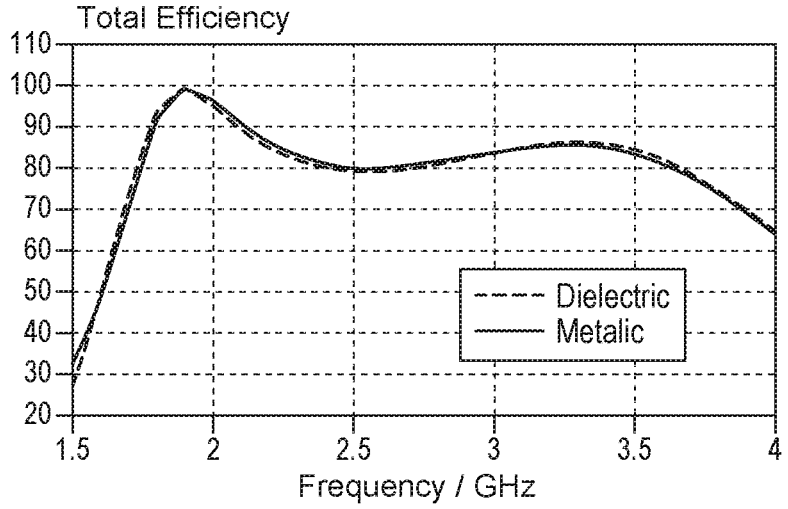
FIG. 10*b* is a graph showing the total efficiency (in %) of the dual-band antenna for customer-premise equipment (CPE) applications of FIGS. 1*a* and 1*b*.
Figure 10C:
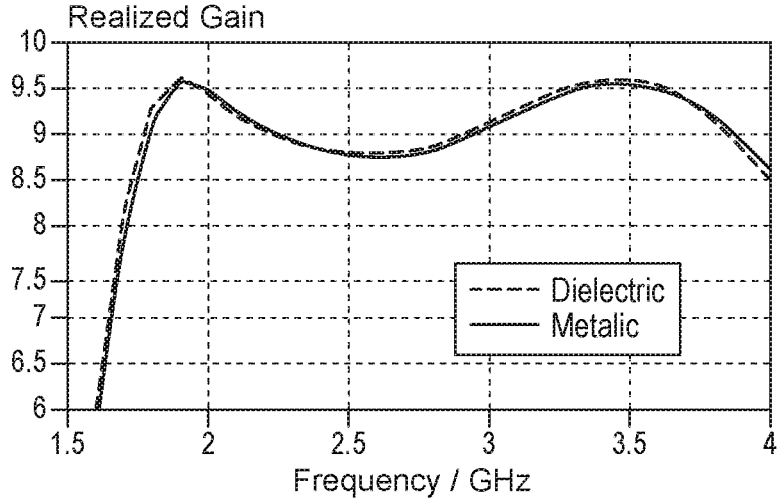
FIG. 10*c* is a graph showing the antenna peak realized gain (in dBi) of the dual-band antenna for customer-premise equipment (CPE) applications of FIGS. 1*a* and 1*b*.

FIG. 10*b* shows a graph indicating the total efficiency in percentage of an antenna according to the present invention. The x-axis shows the frequency in GHz. FIG. 10*c* shows a graph of the antenna peak realized gain in dBi. Again, the x-axis shows the frequency in GHz.

Figure 11:
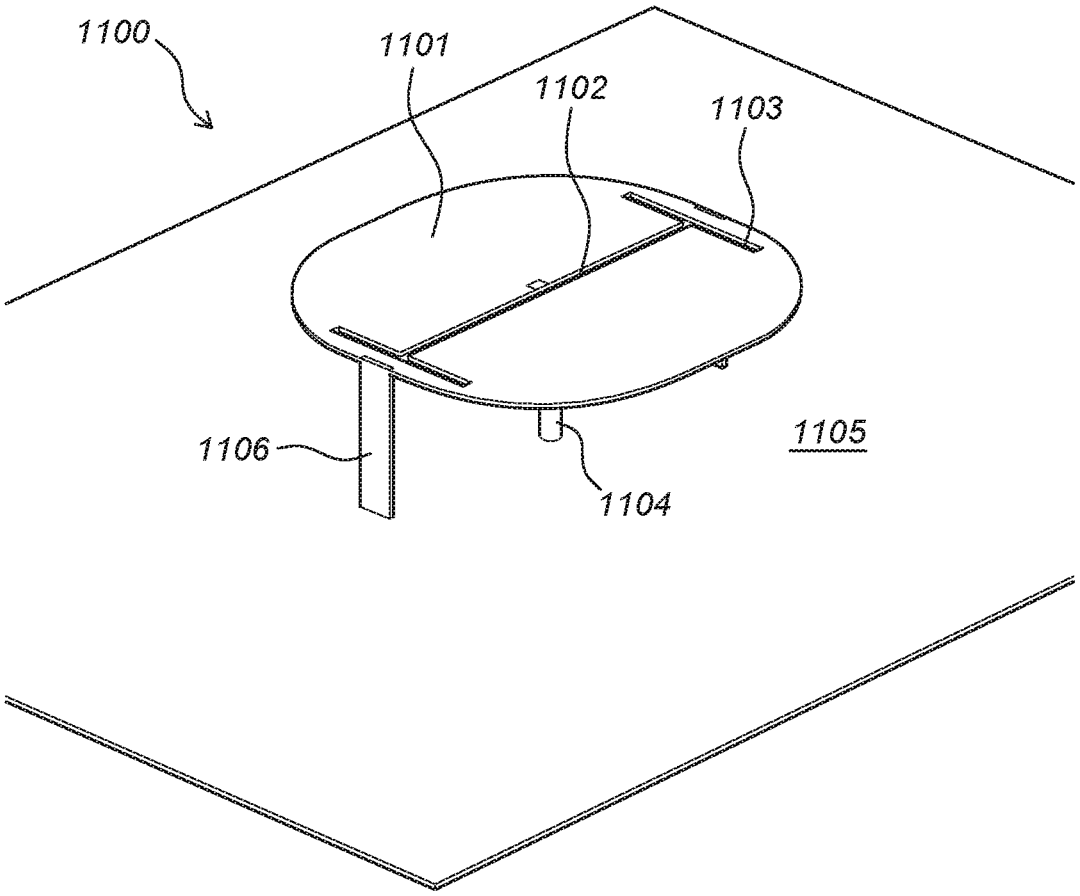
FIG. 11 is a perspective view of another alternative embodiment of the dual-band antenna for customer-premise equipment (CPE) applications.

FIG. 11 shows a possible embodiment of an antenna (1100) according to the present invention. The antenna (1100) comprises a radiating element (1101). The radiating element (1101) encloses a first slot (1102) extending in a first direction and two second slots (103) extending in a second direction perpendicular to the first direction. Each outer end of the first slot (1102) is connected to a second slot (1103). The antenna (1100) further comprises a probing structure (1104) connected to the radiating element (1101), a conductive ground plane (1105) and two mounting elements (1106) for mounting the radiating element (1101) on the ground plane (1105) at a predetermined distance from said ground plane (1105). The main difference between this embodiment of the antenna (1100) and the antenna (100) shown in FIGS. 1*a* and 1 *b* is that this radiating element (1101) does not enclose cut-out portions. The effects thereof on the performance of the antenna is shown in FIGS. 12*a-c*.

Figure 12A:
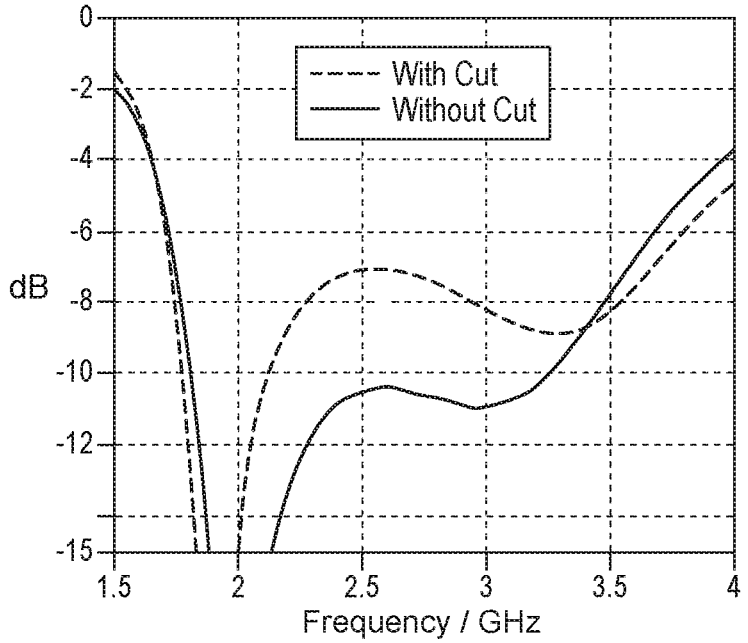
FIG. 12*a* is a graph showing the magnitude of the input reflection coefficient (in dB) of the dual-band antennas for customer-premise equipment (CPE) applications of FIGS. 1*a* and 1*b*, and also of FIG. 11.

FIG. 12*a* shows a graph presenting the magnitude of the input reflection coefficient in dB of antennas as shown in FIGS. 1*a* and 1 *b* and FIG. 11. The x-axis shows the frequency in GHz, the y-axis shows the magnitude of the input reflection coefficient in dB. The antenna having cut-out portions provides the best performance at the higher frequency band. The matching level is the best for antennas without a cut-out portion.

Figure 12B:
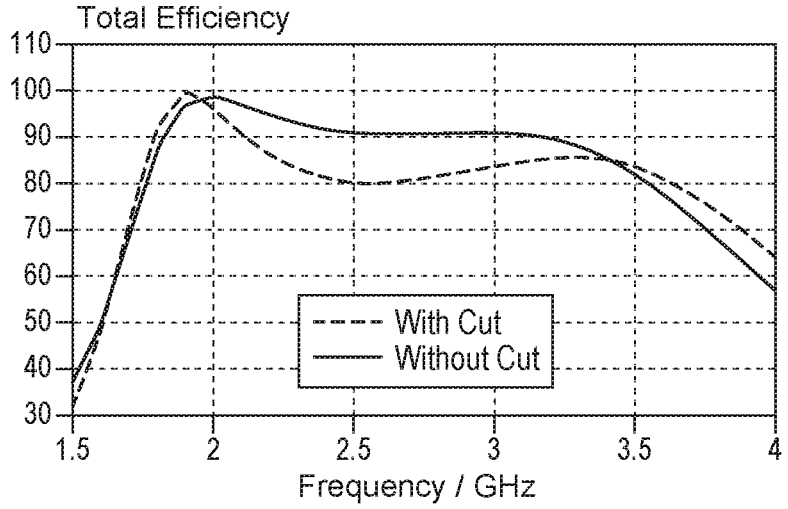
FIG. 12*b* is a graph showing the total efficiency (in %) of the dual-band antennas for customer-premise equipment (CPE) applications of FIGS. 1*a* and 1*b*, and also of FIG. 11.
Figure 12C:
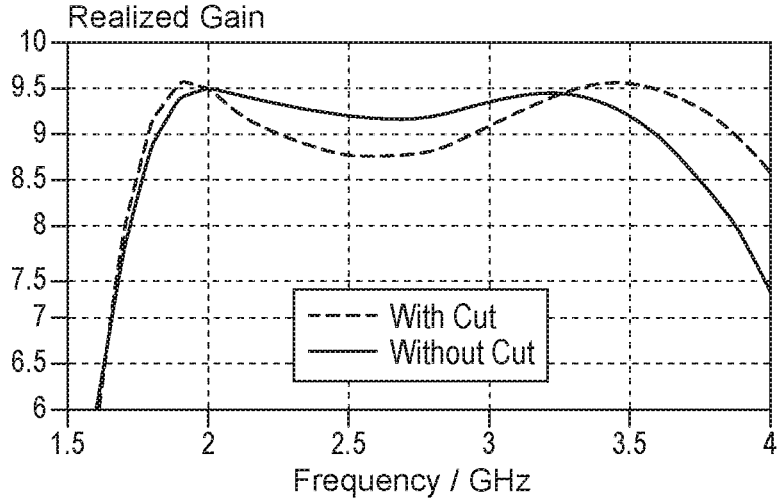
FIG. 12*c* is a graph showing the antenna peak realized gain (in dBi) of the dual-band antennas for customer-premise equipment (CPE) applications of FIGS. 1*a* and 1*b*, and also of FIG. 11.
Figure 13A:
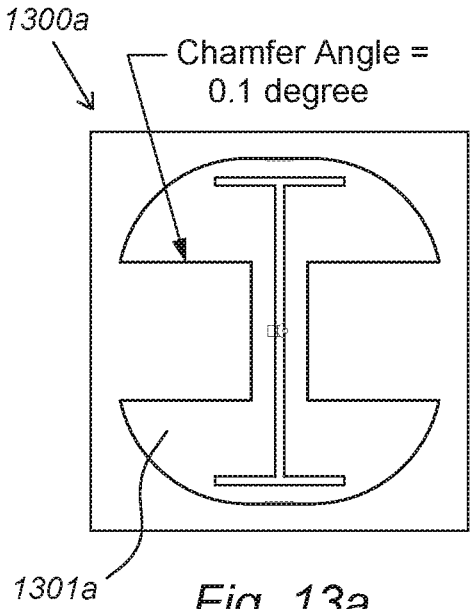
FIG. 13*a* is a plan view of another alternative embodiment of the dual-band antenna for customer-premise equipment (CPE) applications.
Figure 13B:
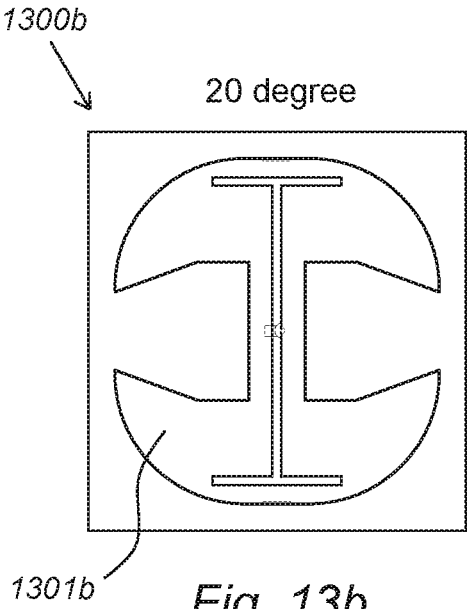
FIG. 13*b* is a plan view of another alternative embodiment of the dual-band antenna for customer-premise equipment (CPE) applications.
Figure 13C:
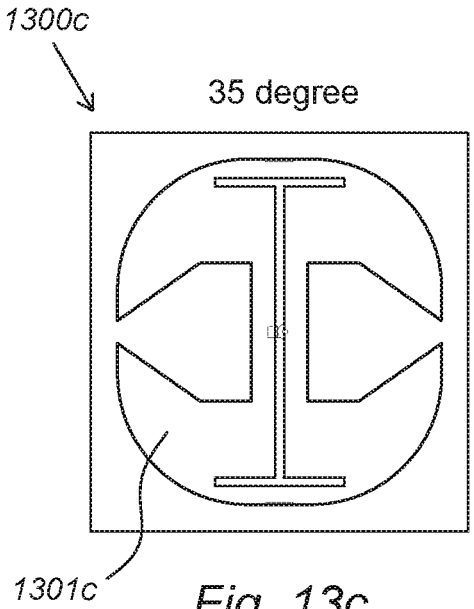
FIG. 13*c* is a plan view of another alternative embodiment of the dual-band antenna for customer-premise equipment (CPE) applications.
Figure 13D:
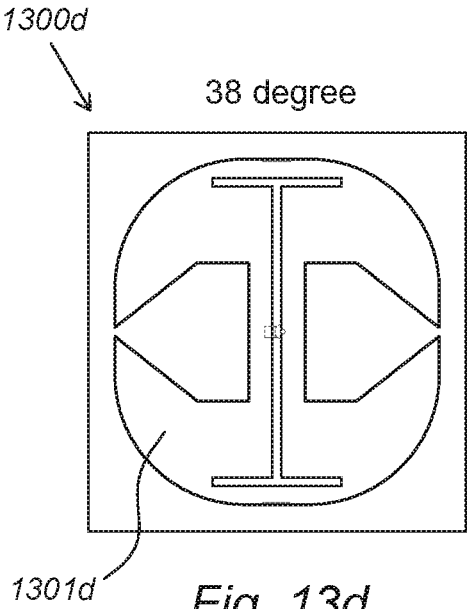
FIG. 13*d* is a plan view of another alternative embodiment of the dual-band antenna for customer-premise equipment (CPE) applications.

FIG. 12*b* shows a graph indicating the total efficiency in percentage of an antenna according to the present invention. The x-axis shows the frequency in GHz. FIG. 12*c* shows a graph of the antenna peak realized gain in dBi. Again, the x-axis shows the frequency in GHz.

FIGS. 13*a*-13*d* show different possible embodiments of antennas (1300*a*, 1300*b*, 1300*c*, 1300*d*) according to the present invention. The figure in particular shows the influence of the chamfer angle on the shape of the radiating element (1301*a*, 1301*b*, 1301*c*, 1301*d*) of the antenna (1300*a*, 1300*b*, 1300*c*, 1300*d*).

Figure 14A:
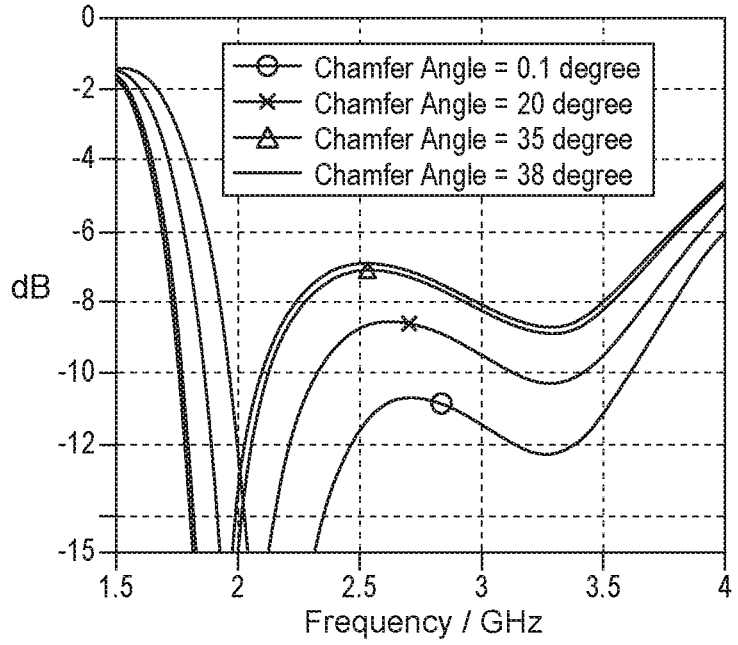
FIG. 14*a* is a graph showing the magnitude of the input reflection coefficient (in dB) of each of the dual-band antennas for customer-premise equipment (CPE) applications of FIGS. 13*a*-13*d*.

FIG. 14*a* shows a graph presenting the magnitude of the input reflection coefficient in dB of antennas as shown in FIGS. 11*a*-11*d*. The x-axis shows the frequency in GHz, the y-axis shows the magnitude of the input reflection coefficient in dB. As the chamfer angle increases, the first antenna resonance tends to shift to lower frequency.

Figure 14B:
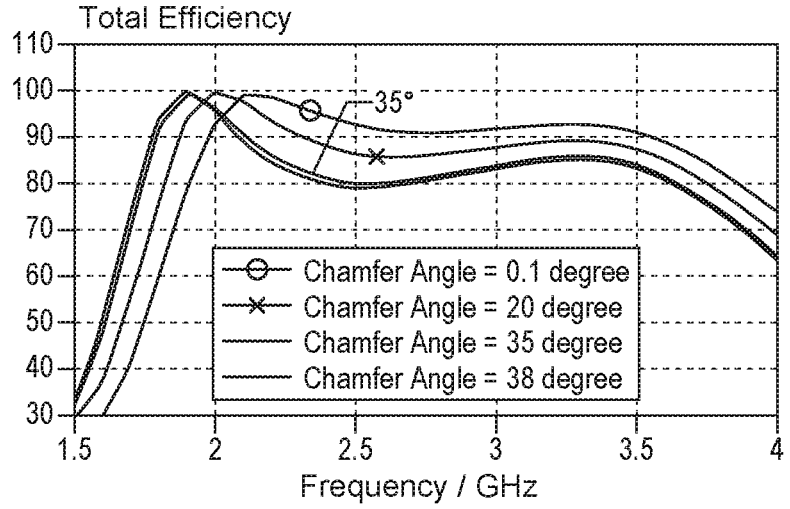
FIG. 14*b* is a graph showing the total efficiency (in %) of each of the dual-band antennas for customer-premise equipment (CPE) applications of FIGS. 13*a*-13*d*.
Figure 14C:
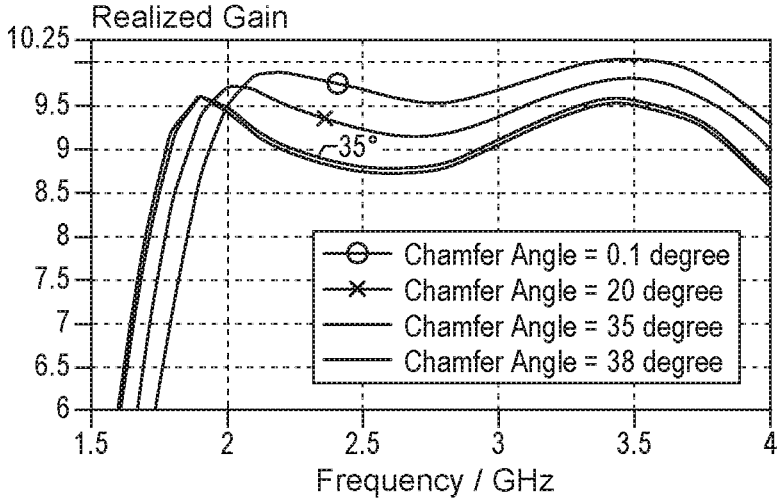
FIG. 14*c* is a graph showing the antenna peak realized gain (in dBi) of each of the dual-band antennas for customer-premise equipment (CPE) applications of FIGS. 13*a*-13*d*.
Figure 15A:
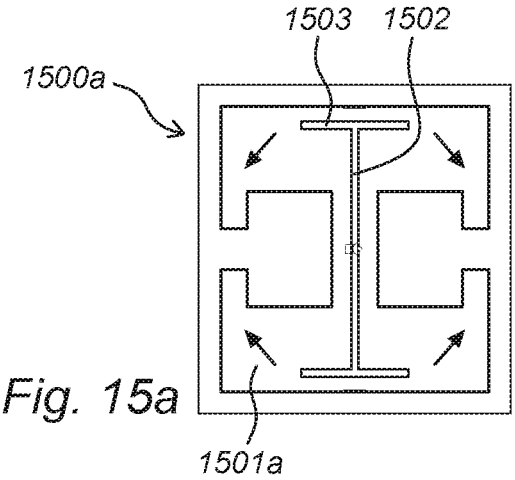
FIG. 15*a* is a plan view of another alternative embodiment of the dual-band antenna for customer-premise equipment (CPE) applications.
Figure 15B:
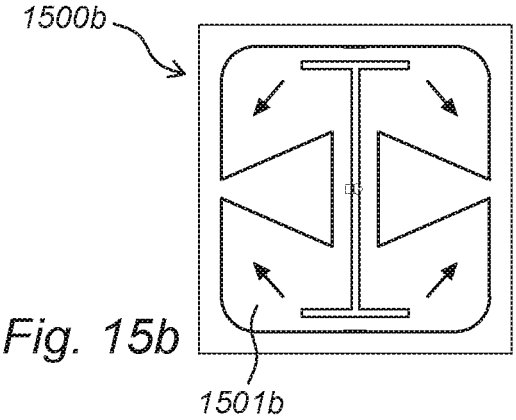
FIG. 15*b* is a plan view of another alternative embodiment of the dual-band antenna for customer-premise equipment (CPE) applications.
Figure 15C:
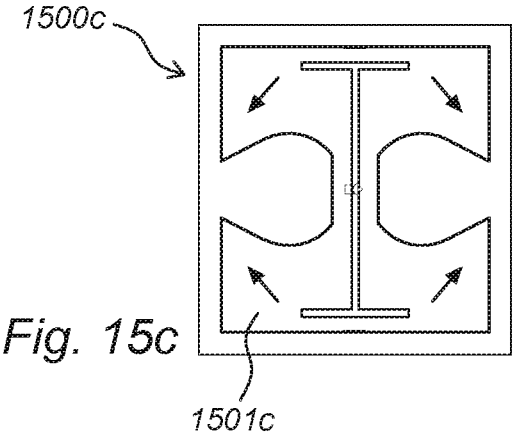
FIG. 15*c* is a plan view of another alternative embodiment of the dual-band antenna for customer-premise equipment (CPE) applications.
Figure 15D:
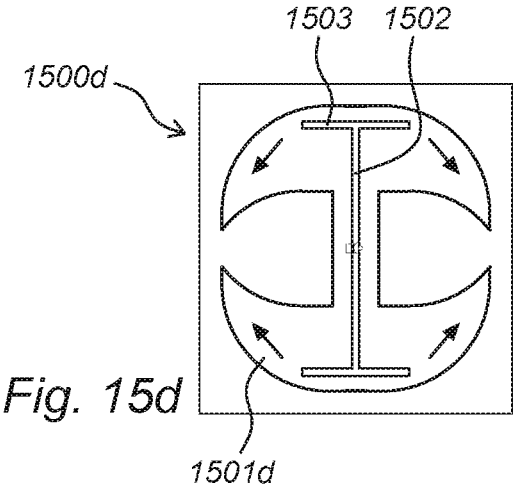
FIG. 15*d* is a plan view of another alternative embodiment of the dual-band antenna for customer-premise equipment (CPE) applications.
Figure 15E:
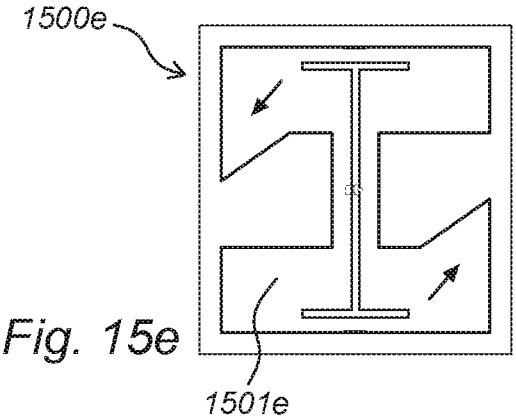
FIG. 15*e* is a plan view of another alternative embodiment of the dual-band antenna for customer-premise equipment (CPE) applications.

FIG. 14*b* shows a graph indicating the total efficiency in percentage of an antenna according to the present invention. The x-axis shows the frequency in GHz. FIG. 14*c* shows a graph of the antenna peak realized gain in dBi. Again, the x-axis shows the frequency in GHz.

FIGS. 15*a*-15*e* show different possible embodiments of antennas (1500*a*, 1500*b*, 1500*c*, 1500*d*, 1500*e*) according to the present invention. The figure in particular shows the shape of the radiating element (1501*a*, 1501*b*, 1501*c*, 1501*d*, 1501*e*) of the antenna (1500*a*, 1500*b*, 1500*c*, 1500*d*, 1500*e*). Each radiating element (1501*a*, 1501*b*, 1501*c*, 1501*d*, 1501*e*) encloses a first slot (1502) extending in a first direction and two second slots (1503) extending in a second direction perpendicular to the first direction. Each outer end of the first slot (1502) is connected to a second slot (1503). Each radiating element (1501*a*, 1501*b*, 1501*c*, 1501*d*, 1501*e*) partially encloses a first cut-out portion (1507*a*, 1507*b*, 1507*c*, 1507*d*, 1507*e*) and partially encloses a second cut-out portion (1508*a*, 1508*b*, 1508*c*, 1508*d*, 1508*e*). The first cut-out portion (1507*a*, 1507*b*, 1507*c*, 1507*d*, 1507*e*) and the second cut-out portion (1508*a*, 1508*b*, 1508*c*, 1508*d*, 1508*e*) are positioned at opposite sides of the first slot (1502) of each radiating element (1501*a*, 1501*b*, 1501*c*, 1501*d*, 1501*e*). The figures show that the cut-out portions may have various shapes. In FIGS. 15*a*-15*d*, the respectively first (1507*a*, 1507*b*, 1507*c*, 1507*d*, 1507*e*) and second cut-out portions (1508*a*, 1508*b*, 1508*c*, 1508*d*, 1508*e*) are substantially identical to each other and positioned symmetrically with respect to the first slot (1502). The first (1507*e*) and second cut-out portions (1508*e*) of the embodiment of FIG. 15*e* have an inverted shape. This embodiment is in particular suitable for wideband operation. It is shown that the cut-out portions (1507*a*, 1507*b*, 1507*c*, 1507*d*, 1507*e*, 1508*a*, 1508*b*, 1508*c*, 1508*d*, 1508*e*) comprise opposite side walls which substantially face another. The outer ends, or tips, of the opposite side walls are directed towards another. This is beneficial for the guidance of the current, which current direction is indicated with an arrow in the figures.

It will be apparent that the invention is not limited to the working examples shown and described herein, but that numerous variants are possible within the scope of the attached claims that will be obvious to a person skilled in the art.

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

The ordinal numbers used in this document, like "first", and "second", are used only for identification purposes. Expressions like "horizontal", and "vertical", are relative expressions with respect to a plane defined by the substrate. The verb "comprise" and conjugations thereof used in this patent publication are understood to mean not only "comprise", but are also understood to mean the phrases "contain", "substantially consist of", "formed by" and conjugations thereof.

The invention claimed is:

1. A dual-band directional antenna for customer-premise equipment (CPE) applications, comprising:

at least one conductive radiating element, said at least one conductive radiating element enclosing at least one first slot extending in a first direction and a plurality of second slots extending in a second direction perpendicular to the first direction, wherein each outer end of each first slot is connected to at least one second slot;

a probing structure connected to said at least one conductive radiating element;

a conductive ground plane; and at least one mounting element for mounting said at least one conductive radiating element on the ground plane at a distance from said ground plane, wherein the dual-band directional antenna is configured to operate in two different frequency bands, wherein the at least one conductive radiating element partially encloses at least one first cut-out portion and partially encloses at least one second cut-out portion, wherein said at least one first cut-out portion and said at least one second cut-out portion are positioned at opposite sides of the first slot of said at least one conductive radiating element, wherein said at least one first cut-out portion comprises opposite side walls, wherein a distal end of one of the side walls of the at least one first cut-out portion is directed towards an opposing distal end of the opposing one of the side walls of the at least one first cut-out portion, and wherein said at least one second cut-out portion comprises opposite side walls, wherein a distal end of one of the side walls of the at least one second cut-out portion is directed towards an opposing distal end of the opposing one of the side walls of the at least one second cut-out portion.

2. The dual-band directional antenna according to claim 1, wherein the antenna is configured to operate in overlapping frequency bands allowing the antenna to act as wideband antenna with high-gain characteristics.

3. The dual-band directional antenna according to claim 1, wherein at least one radiating element is a formed by a conductive plate.

4. The dual-band directional antenna according to claim 1, wherein at least one radiating element has rounded edges.

5. The dual-band directional antenna according to claim 1, wherein each radiating element is provided with a single first slot and two second slots.

6. The dual-band directional antenna according to claim 1, wherein the length of at least one radiating element smaller than or equal to 64 millimeter.

7. The dual-band directional antenna according to claim 1, wherein the width of at least one radiating element is smaller than or equal to the length of said radiating element, and wherein said width is at least 56 millimeter.

8. The dual-band directional antenna according to claim 1, wherein the distance between each radiating element and the ground plane is at least 20 millimeter.

9. The dual-band directional antenna according to claim 1, wherein each outer end of each first slot is connected to a central portion of at least one second slot.

10. The dual-band directional antenna according to claim 1, wherein the first slot and second slots together define an overall slot, wherein said overall slot has a substantially mirror symmetric design.

11. The dual-band directional antenna according to claim 1, wherein each cut-out portion is partially surrounded by the first slot and the second slots.

12. The dual-band directional antenna according to claim 1, wherein at least one cut-out portion comprises a substantially rectangular base portion facing the first slot.

13. The dual-band directional antenna according to claim 1, wherein at least one cut-out portion comprises a lower wall which faces the first slot and which is substantially parallel to the first slot.

14. The dual-band directional antenna according to claim 1, wherein at least one cut-out portion comprises opposite side walls, which side walls are at least partially chamfered.

15. The dual-band directional antenna according to claim 14, wherein at least one cut-out portion comprises opposite side walls, which side walls are at least partially chamfered towards each other in a direction away from the first slot.

16. The dual-band directional antenna according to claim 1, wherein the antenna is configured to operate both in a first frequency band of 1.71-2.7 GHz and a second frequency band of 3.3-3.8 GHz.

17. The dual-band directional antenna according to claim 1, wherein the probing structure comprises a coaxial cable acting connected to a radiating element.

18. The dual-band directional antenna according to claim 1, wherein the slots are punched into each radiating element.

19. A wireless device for customer-premise equipment (CPE) applications, comprising at least one dual-band directional antenna according to claim 1.

* * * * *